US009586104B2

(12) United States Patent
Roach

(10) Patent No.: US 9,586,104 B2
(45) Date of Patent: Mar. 7, 2017

(54) MULTI-MATERIAL GOLF CLUB HEAD

(71) Applicant: Cobra Golf Incorporated, Carlsbad, CA (US)

(72) Inventor: Ryan L. Roach, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 243 days.

(21) Appl. No.: 14/524,604

(22) Filed: Oct. 27, 2014

(65) Prior Publication Data

US 2015/0045130 A1 Feb. 12, 2015

Related U.S. Application Data

(63) Continuation-in-part of application No. 12/759,959, filed on Apr. 14, 2010, now Pat. No. 8,870,682,
(Continued)

(51) Int. Cl.
*A63B 53/04* (2015.01)
*A63B 57/00* (2015.01)
(Continued)

(52) U.S. Cl.
CPC ..... *A63B 53/047* (2013.01); *A63B 53/04* (2013.01); *A63B 60/54* (2015.10); *A63B 69/3635* (2013.01); *A63B 71/0622* (2013.01); *A63B 2053/042* (2013.01); *A63B 2053/0408* (2013.01); *A63B 2053/0416* (2013.01); *A63B 2053/0479* (2013.01); *A63B 2053/0491* (2013.01); *A63B 2069/362* (2013.01);
(Continued)

(58) Field of Classification Search
USPC ..... 473/324–350
See application file for complete search history.

(56) References Cited

U.S. PATENT DOCUMENTS 819,900 A 5/1906 Martin
1,319,233 A 10/1919 Mattern
(Continued)

FOREIGN PATENT DOCUMENTS

JP 6-343722 12/1994
JP 7-155410 6/1995
(Continued)

OTHER PUBLICATIONS

Jackson, 1994, The Modern Guide to Golf Clubmaking, Ohio: Dynacraft Golf Products, Inc.:237.
(Continued)

*Primary Examiner* — Alvin Hunter
(74) *Attorney, Agent, or Firm* — Brown Rudnick LLP; Mark S. Leonardo

(57) ABSTRACT

The present invention relates to a golf club head having a multifunctional damping assembly. In certain aspects, the invention provides a damping assembly configured to provide dampening of vibrational response of the club head upon impact of the club face with a golf ball, thereby improving the feel of the club. The damping assembly is further configured to provide information to a golfer in the form of visual and/or audible feedback indicative of one or more characteristics of a golf ball strike with the club face.

15 Claims, 27 Drawing Sheets

Related U.S. Application Data which is a continuation-in-part of application No. 11/896,238, filed on Aug. 30, 2007, now Pat. No. 7,819,757, which is a continuation-in-part of application No. 11/822,197, filed on Jul. 3, 2007, now Pat. No. 7,922,604.

(60) Provisional application No. 60/832,228, filed on Jul. 21, 2006.

(51) Int. Cl.
*A63B 69/36* (2006.01)
*A63B 71/06* (2006.01)

(52) U.S. Cl.
CPC ..... *A63B 2071/0625* (2013.01); *A63B 2071/0647* (2013.01); *A63B 2207/02* (2013.01); *A63B 2209/00* (2013.01); *A63B 2209/023* (2013.01); *A63B 2220/51* (2013.01); *A63B 2220/833* (2013.01); *A63B 2225/50* (2013.01)

(56) References Cited

U.S. PATENT DOCUMENTS 1,534,600 A 4/1925 Mattern
2,429,351 A 10/1947 Fetterolf
2,686,056 A 8/1954 Oquist
3,084,940 A 4/1963 Cissel
3,695,618 A 10/1972 Woolley et al.
3,881,733 A 5/1975 Csernits
3,970,236 A 7/1976 Rogers
3,975,023 A 8/1976 Inamori
4,027,885 A 6/1977 Rogers
4,340,230 A 7/1982 Churchward
4,398,965 A 8/1983 Campau
4,523,759 A 6/1985 Igarashi
4,607,846 A 8/1986 Perkins
4,681,322 A 7/1987 Straza et al.
4,687,205 A 8/1987 Tominaga et al.
4,792,139 A 12/1988 Nagasaki et al.
4,811,950 A 3/1989 Kobayashi
4,874,171 A 10/1989 Ezaki et al.
4,884,812 A 12/1989 Nagasaki et al.
4,928,972 A 5/1990 Nakanishi et al.
4,957,294 A 9/1990 Long
4,964,640 A 10/1990 Nakanishi et al.
D321,920 S 11/1991 Parente et al.
5,104,457 A 4/1992 Viljoen et al.
5,106,094 A 4/1992 Desbiolles et al.
5,190,290 A 3/1993 Take
5,221,087 A 6/1993 Fenton et al.
D339,183 S 9/1993 Stites, III
5,242,167 A 9/1993 Antonious
D343,216 S 1/1994 Chorne
5,290,036 A 3/1994 Fenton et al.
5,299,807 A 4/1994 Hutin
5,303,922 A 4/1994 Lo
5,308,062 A 5/1994 Hogan
5,316,298 A 5/1994 Hutin et al.
5,377,979 A 1/1995 Long
5,377,985 A 1/1995 Ohnishi
5,398,929 A 3/1995 Kitaichi
5,403,007 A 4/1995 Chen
5,405,137 A 4/1995 Vincent et al.
5,409,229 A 4/1995 Schmidt et al.
5,413,336 A 5/1995 Iwanaga
5,431,396 A 7/1995 Shieh
5,433,440 A 7/1995 Lin
5,492,327 A 2/1996 Biafore
5,518,243 A 5/1996 Redman
5,544,885 A 8/1996 Besnard et al.
5,564,705 A 10/1996 Kobayashi et al.
5,586,947 A 12/1996 Hutin
5,586,948 A 12/1996 Mick
5,588,923 A 12/1996 Schmidt et al.
5,605,511 A 2/1997 Schmidt et al.
5,616,088 A 4/1997 Aizawa et al.
5,626,530 A 5/1997 Schmidt et al.
5,643,111 A 7/1997 Igarashi
5,643,112 A 7/1997 Besnard et al.
5,658,208 A 8/1997 Shimasaki
5,669,826 A 9/1997 Chang et al.
5,669,829 A 9/1997 Lin
5,683,310 A 11/1997 Chen
5,692,972 A 12/1997 Langslet
5,697,855 A 12/1997 Aizawa
5,704,849 A 1/1998 Schmidt et al.
5,713,800 A 2/1998 Su
5,720,673 A 2/1998 Anderson
5,749,794 A 5/1998 Kobayashi et al.
5,766,092 A 6/1998 Mimeur et al.
5,772,527 A 6/1998 Liu
5,776,010 A 7/1998 Helmstetter et al.
5,833,551 A 11/1998 Vincent et al.
5,863,261 A 1/1999 Eggiman
5,890,973 A 4/1999 Gamble
5,924,939 A 7/1999 Grace et al.
5,944,619 A 8/1999 Cameron
5,967,903 A 10/1999 Cheng
5,993,329 A 11/1999 Shieh
6,001,030 A 12/1999 Delaney
6,042,486 A 3/2000 Gallagher
6,045,456 A 4/2000 Best et al.
6,080,069 A 6/2000 Long
6,089,992 A 7/2000 Onuki et al.
6,095,931 A 8/2000 Hettinger et al.
6,102,426 A * 8/2000 Lazarus ..... A63B 60/54 280/602
6,102,812 A 8/2000 Takeda
RE36,950 E 11/2000 Allen
6,179,726 B1 1/2001 Satoh et al.
6,183,376 B1 2/2001 Peters et al.
6,217,460 B1 4/2001 Broadbridge et al.
6,231,458 B1 5/2001 Cameron et al.
6,248,021 B1 * 6/2001 Ognjanovic ..... A63B 69/3617 473/131
6,254,494 B1 7/2001 Hasebe et al.
6,267,691 B1 7/2001 Dammen
6,306,048 B1 10/2001 McCabe et al.
6,319,149 B1 11/2001 Lee
6,319,150 B1 11/2001 Werner et al.
6,334,818 B1 1/2002 Cameron et al.
6,338,683 B1 1/2002 Kosmatka
6,354,962 B1 3/2002 Galloway et al.
6,358,158 B2 3/2002 Peters et al.
6,364,789 B1 4/2002 Kosmatka
6,379,262 B1 4/2002 Boone
6,381,828 B1 5/2002 Boyce et al.
6,390,933 B1 5/2002 Galloway et al.
6,398,666 B1 6/2002 Evans et al.
6,428,426 B1 8/2002 Helmstetter et al.
6,428,427 B1 8/2002 Kosmatka
6,440,010 B1 8/2002 Deshmukh
6,443,857 B1 9/2002 Chuang
6,471,604 B2 10/2002 Hocknell et al.
6,478,690 B2 11/2002 Helmstetter et al.
6,482,104 B1 11/2002 Gilbert
6,491,592 B2 12/2002 Cackett et al.
6,491,593 B2 12/2002 Takeda
6,524,196 B1 2/2003 Yeh
6,530,846 B1 3/2003 Mase
6,554,722 B2 4/2003 Erickson et al.
6,558,272 B2 5/2003 Helmstetter et al.
6,565,452 B2 5/2003 Helmstetter et al.
6,569,033 B2 5/2003 Kosmatka
6,582,321 B2 6/2003 Galloway et al.
6,582,323 B2 6/2003 Soracco et al.
6,592,468 B2 7/2003 Vincent et al.
6,592,469 B2 7/2003 Gilbert
6,602,150 B1 8/2003 Kosmatka
6,605,007 B1 8/2003 Bissonnette et al.
6,616,547 B2 9/2003 Vincent et al.
6,623,377 B2 9/2003 Evans et al.

(56) References Cited

U.S. PATENT DOCUMENTS 6,638,183 B2 10/2003 Takeda
6,659,885 B1 12/2003 Knuth
6,663,504 B2 12/2003 Hocknell et al.
6,688,989 B2 2/2004 Best
6,709,345 B2 3/2004 Iwata et al.
6,719,641 B2 4/2004 Dabbs et al.
6,739,983 B2 5/2004 Helmstetter et al.
6,743,114 B2 6/2004 Best
6,743,117 B2 6/2004 Gilbert
6,769,998 B2 8/2004 Clausen et al.
6,773,361 B1 8/2004 Lee
6,811,496 B2 11/2004 Wahl et al.
6,824,475 B2 11/2004 Burnett et al.
6,835,144 B2 12/2004 Best
6,849,005 B2 2/2005 Rife
6,855,066 B2 2/2005 Best
6,857,973 B2 2/2005 Wieland et al.
6,860,820 B2 3/2005 Specht
6,860,822 B2 3/2005 Vrska, Jr.
6,863,626 B2 3/2005 Evans et al.
6,872,153 B2 3/2005 Gilbert et al.
6,875,124 B2 4/2005 Gilbert et al.
6,887,164 B2 5/2005 Dewanjee et al.
6,899,638 B2 5/2005 Iwata et al.
6,902,495 B2 6/2005 Pergande et al.
6,902,945 B2 6/2005 Mann et al.
6,918,840 B2 7/2005 Stites et al.
6,921,344 B2 7/2005 Gilbert et al.
6,923,732 B2 8/2005 Stites et al.
6,929,563 B2 8/2005 Nishitani
6,932,717 B2 8/2005 Hou et al.
6,960,142 B2 11/2005 Bissonnette et al.
6,964,620 B2 11/2005 Gilbert et al.
6,966,848 B2 11/2005 Kusumoto
6,976,924 B2 12/2005 Gilbert et al.
6,984,180 B2 1/2006 Hasebe
6,991,559 B2 1/2006 Yabu
6,997,820 B2 2/2006 Willett et al.
7,008,331 B2 3/2006 Chen
7,018,305 B2 3/2006 Sugimoto
7,025,693 B2 4/2006 Sugimoto
7,029,403 B2 4/2006 Rice et al.
7,041,003 B2 5/2006 Bissonnette et al.
7,048,647 B2 5/2006 Burrows
7,048,648 B2 5/2006 Breier et al.
7,070,513 B2 7/2006 Takeda et al.
7,086,962 B2 8/2006 Galloway et al.
7,097,572 B2 8/2006 Yabu
7,126,339 B2 10/2006 Nagai et al.
7,144,337 B2 12/2006 Hirano
7,147,575 B2 12/2006 Galloway et al.
7,153,219 B2 12/2006 Reed et al.
7,160,204 B2 1/2007 Huang
7,169,059 B2 1/2007 Rice et al.
7,182,698 B2 2/2007 Tseng
7,186,188 B2 3/2007 Gilbert et al.
7,192,362 B2 3/2007 Gilbert et al.
7,192,364 B2 3/2007 Long
7,207,898 B2 4/2007 Rice et al.
7,207,899 B2 4/2007 Imamoto
7,207,900 B2 4/2007 Nicolette et al.
7,214,142 B2 5/2007 Meyer et al.
7,220,189 B2 5/2007 Wieland et al.
7,220,190 B2 5/2007 Hirano
7,232,380 B2 6/2007 Nakahara
7,238,119 B2 7/2007 Roach et al.
7,244,188 B2 7/2007 Best
7,258,626 B2 8/2007 Gibbs et al.
7,261,643 B2 8/2007 Rice et al.
7,273,421 B2 9/2007 Knuth
7,278,925 B2 10/2007 Oyama
7,326,127 B2 2/2008 Hou et al.
7,338,387 B2 3/2008 Nycum et al.
7,338,388 B2 3/2008 Schweigert et al.
7,347,794 B2 3/2008 Schweigert
7,361,099 B2 4/2008 Rice et al.
7,367,899 B2 5/2008 Rice et al.
7,384,348 B2 6/2008 Lin et al.
7,387,579 B2 6/2008 Lin et al.
7,422,527 B2 9/2008 Rice et al.
7,422,528 B2 9/2008 Gibbs et al.
7,435,189 B2 10/2008 Hirano
7,448,960 B2 11/2008 Gibbs et al.
7,473,190 B2 1/2009 Hocknell et al.
7,476,162 B2 1/2009 Stites et al.
7,481,717 B2 1/2009 Knuth
7,481,719 B2 1/2009 Imamoto
7,556,572 B2 7/2009 Stites et al.
7,588,503 B2 9/2009 Roach et al.
7,597,633 B2 10/2009 Shimazaki et al.
7,614,962 B1 11/2009 Clausen
7,654,914 B2 2/2010 Roach et al.
7,662,050 B2 2/2010 Gilbert et al.
7,713,141 B2 5/2010 Yamamoto
7,753,808 B2 7/2010 Matsunaga
7,819,757 B2 10/2010 Soracco et al.
7,833,110 B2 11/2010 Nakamura
7,871,338 B2 1/2011 Nakano
7,914,395 B2 3/2011 Stites et al.
7,922,604 B2 4/2011 Roach et al.
7,980,960 B2 7/2011 Gilbert et al.
7,997,999 B2 8/2011 Roach et al.
8,133,129 B2 3/2012 Boyd et al.
8,206,241 B2 6/2012 Boyd et al.
8,221,263 B2 7/2012 Tavares et al.
8,388,464 B2 3/2013 Gilbert et al.
8,491,412 B2 7/2013 Roach et al.
8,870,682 B2 10/2014 Roach
9,170,419 B2 * 10/2015 Charlson ..... G02B 26/004
2002/0042307 A1 4/2002 Deshmukh
2002/0094883 A1 7/2002 Chuang
2002/0165041 A1 11/2002 Takeda
2003/0013543 A1 1/2003 Helmstetter et al.
2003/0022729 A1 1/2003 Pergande et al.
2003/0032499 A1 2/2003 Wahl et al.
2003/0045372 A1 3/2003 Vrska
2003/0092502 A1 5/2003 Pergande et al.
2003/0125129 A1 7/2003 Saksun
2003/0139225 A1 7/2003 Rife
2003/0195058 A1 10/2003 Rice et al.
2003/0199334 A1 10/2003 Bissonnette et al.
2003/0199335 A1 10/2003 Bissonnette et al.
2003/0220157 A1 11/2003 Dennis et al.
2003/0228928 A1 12/2003 Yabu
2004/0023730 A1 2/2004 Nagai et al.
2004/0043830 A1 3/2004 Imamoto
2004/0082405 A1 4/2004 Sano
2004/0116200 A1 6/2004 Helmstetter et al.
2004/0242339 A1 12/2004 Gilbert et al.
2005/0009633 A1 1/2005 Rice et al.
2005/0009634 A1 1/2005 Rice et al.
2005/0096150 A1 5/2005 Hou et al.
2005/0096151 A1 5/2005 Hou et al.
2005/0101407 A1 5/2005 Hirano
2005/0137029 A1 6/2005 Evans et al.
2005/0187034 A1 8/2005 Rice et al.
2005/0192118 A1 9/2005 Rice et al.
2005/0209019 A1 9/2005 Schweigert
2005/0239572 A1 10/2005 Roach et al.
2005/0255938 A1 11/2005 Soracco
2005/0272524 A1 12/2005 Oh
2005/0277484 A1 12/2005 Reed et al.
2006/0025234 A1 2/2006 Nicolette et al.
2006/0025235 A1 2/2006 Nakahara et al.
2006/0046868 A1 3/2006 Murphy
2006/0052183 A1 3/2006 Soracco et al.
2006/0052184 A1 3/2006 Soracco et al.
2006/0068932 A1 3/2006 Rice et al.
2006/0111198 A1 5/2006 Matsunaga
2006/0194641 A1 8/2006 Best
2007/0049415 A1 3/2007 Shear
2007/0066420 A1 3/2007 Imamoto et al.
2007/0281796 A1 12/2007 Gilbert et al.
2008/0020860 A1 1/2008 Imamoto

(56) References Cited

U.S. PATENT DOCUMENTS

| | | | |
|---|---|---|---|
| 2008/0058119 | A1 | 3/2008 | Soracco et al. |
| 2009/0118037 | A1 | 5/2009 | Roach et al. |
| 2011/0143857 | A1 | 6/2011 | Roach et al. |

FOREIGN PATENT DOCUMENTS

| | | | |
|---|---|---|---|
| JP | 07-031697 | Y2 | 7/1995 |
| JP | 7-275412 | | 10/1995 |
| JP | 8-164229 | | 6/1996 |
| JP | 8-257171 | | 10/1996 |
| JP | 9-000666 | | 1/1997 |
| JP | 3032837 | U | 1/1997 |
| JP | 9-225077 | | 2/1997 |
| JP | 9-066125 | | 3/1997 |
| JP | 9-117537 | | 5/1997 |
| JP | 9-154986 | A | 6/1997 |
| JP | 9-173513 | A | 7/1997 |
| JP | 9-215795 | | 8/1997 |
| JP | 9-215796 | | 8/1997 |
| JP | 9-225075 | A | 9/1997 |
| JP | 9-239075 | | 9/1997 |
| JP | 9-276455 | | 10/1997 |
| JP | 9-299519 | | 11/1997 |
| JP | 9-322952 | | 12/1997 |
| JP | 10-151231 | | 6/1998 |
| JP | 10-234897 | | 9/1998 |
| JP | 10-314349 | | 12/1998 |
| JP | 11-57085 | | 3/1999 |
| JP | 11-114109 | | 4/1999 |
| JP | 11-128412 | | 5/1999 |
| JP | 11-161863 | | 6/1999 |
| JP | 11-169493 | | 6/1999 |
| JP | 11-299938 | | 11/1999 |
| JP | 11-299939 | | 11/1999 |
| JP | 11-299940 | | 11/1999 |
| JP | 11-313906 | | 11/1999 |
| JP | 2001-190720 | | 11/1999 |
| JP | 2000-126339 | A | 5/2000 |
| JP | 2000-197718 | A | 7/2000 |
| JP | 2000-296192 | A | 10/2000 |
| JP | 2001-029521 | A | 2/2001 |
| JP | 2001-058015 | A | 3/2001 |
| JP | 2001-137396 | A | 5/2001 |
| JP | 2001-161868 | A | 6/2001 |
| JP | 2001-190720 | A | 7/2001 |
| JP | 2001-212270 | A | 8/2001 |
| JP | 2001-346918 | A | 12/2001 |
| JP | 2002-102396 | A | 4/2002 |
| JP | 2002-165903 | A | 6/2002 |
| JP | 2002-172187 | A | 6/2002 |
| JP | 2002-186692 | A | 7/2002 |
| JP | 2002-191726 | A | 7/2002 |
| JP | 2002-191730 | A | 7/2002 |
| JP | 2002-233596 | A | 8/2002 |
| JP | 2002-239037 | A | 8/2002 |
| JP | 2002-315854 | A | 10/2002 |
| JP | 2002-360747 | A | 12/2002 |
| JP | 2003-062134 | A | 3/2003 |
| JP | 2003-117032 | A | 4/2003 |
| JP | 2003-135630 | A | 5/2003 |
| JP | 2003-154040 | A | 5/2003 |
| JP | 2003-236021 | A | 8/2003 |
| JP | 2003-339921 | A | 12/2003 |
| JP | 2004-135963 | A | 5/2004 |
| JP | 2004-202044 | A | 7/2004 |
| JP | 2004-261450 | A | 9/2004 |
| JP | 2004-329544 | A | 11/2004 |
| JP | 2005-052272 | A | 3/2005 |
| JP | 2005-143591 | A | 6/2005 |
| JP | 2005-305115 | A | 11/2005 |
| JP | 2006-000554 | A | 1/2006 |
| JP | 2006-043460 | A | 2/2006 |
| JP | 2006-043461 | A | 2/2006 |
| JP | 2006-087928 | A | 4/2006 |
| JP | 2006-129936 | A | 5/2006 |
| JP | 2007-029710 | A | 2/2007 |
| JP | 2007-117743 | A | 5/2007 |
| JP | 2007-125399 | A | 5/2007 |
| JP | 2007-229487 | A | 9/2007 |
| JP | 2007-260316 | A | 10/2007 |
| JP | 2007-275231 | A | 10/2007 |
| JP | 2008-023348 | A | 2/2008 |
| JP | 2008-100056 | A | 5/2008 |
| JP | 2010-273804 | A | 12/2010 |
| JP | 2011-004810 | A | 1/2011 |
| JP | 2011-115607 | A | 6/2011 |
| WO | 99/20358 | A1 | 4/1999 |

OTHER PUBLICATIONS

Japanese Office Action dated Sep. 28, 2010 (mailed Oct. 19, 2010) in Application No. 2007-212484.

U. S. Office Action dated Apr. 12, 2010 in U.S. Appl. No. 11/822,197. U.S. Appl. No. 11/822,197.

U. S. Office Action dated Dec. 30, 2009 in U.S. Appl. No. 11/896,238.

U. S. Office Action dated Mar. 19, 2010 in U.S. Appl. No. 11/896,238.

U. S. Office Action dated Mar. 6, 2009 in U.S. Appl. No. 11/896,238.

U. S. Office Action dated Oct. 21, 2009 in U.S. Appl. No. 11/822,197.

U. S. Office Action, Notice of Allowance dated Dec. 2, 2010 in U.S. Appl. No. 11/822,197.

* cited by examiner

MULTI-MATERIAL GOLF CLUB HEAD

CROSS-REFERENCE TO RELATED APPLICATIONS

This application is a continuation-in-part of U.S. patent application Ser. No. 12/759,959, filed Apr. 14, 2010, which is a continuation-in-part of U.S. patent application Ser. No. 11/896,238, filed on Aug. 30, 2007, now U.S. Pat. No. 7,819,757, which is a continuation-in-part of U.S. patent application Ser. No. 11/822,197, filed on Jul. 3, 2007, now U.S. Pat. No. 7,922,604, which claims the benefit of U.S. Provisional Patent Application No. 60/832,228, filed on Jul. 21, 2006, the contents of each of which are incorporated herein by reference their entireties.

FIELD OF THE INVENTION

The present invention relates to golf clubs, and, more particularly, to a golf club head having a multifunctional damping assembly configured to provide vibration damping as well as feedback indicating one or more characteristics of a golf ball strike.

BACKGROUND

Golf club heads come in many different forms and makes, such as wood- or metal-type, iron-type (including wedge-type club heads), utility- or specialty-type, and putter-type. Each of these styles has a prescribed function and make-up. The present invention will be discussed as relating to iron-type clubs, but the inventive teachings disclosed herein may be applied to other types of clubs.

Iron-type and utility-type golf club heads generally include a front or striking face, a hosel, and a sole. The front face interfaces with and strikes the golf ball. A plurality of grooves, sometimes referred to as "score lines," is provided on the face to assist in imparting spin to the ball. The hosel is generally configured to have a particular look to the golfer, to provide a lodging for the golf shaft, and to provide structural rigidity for the club head. The sole of the golf club is particularly important to the golf shot because it contacts and interacts with the playing surface during the swing.

Perimeter weighting in iron-type golf clubs distributes non-essential mass of the iron towards the perimeter, reducing the effects that off-center hits have on the golf club and producing more accurate and consistent golf ball trajectories. Perimeter weighting is achieved by creating a cavity in the back of the golf club opposite the face or hitting surface. The material weight removed to create this cavity is redistributed around the perimeter of the golf club head. In general, larger cavity volumes correspond to increased amounts of mass distributed around the perimeter.

Removing material from the rear of the club head, however, may reduce the thickness of the club face. Since the club face is the hitting surface, the club face cannot be so thin that the strength of the club face surface is not sufficient to withstand the stress resulting from the club face striking a golf ball. A reduction in the thickness of the club face may also increase the vibrational response of the club head upon impact of the club face with the golf ball, which may have unappealing vibration and deflection characteristics that adversely affect the feel of shots and the energy transfer to the golf ball during impact.

Golfers tend to be sensitive to the feel of a golf club, particularly feel of the club upon impact of the club face with the golf ball. Accordingly, some designers try to dampen these unappealing vibrations by adding an elastic material in the club head. There are various examples of secondary material incorporation into iron golf club heads for vibration damping. For example, some iron golf club heads include damping inserts fitted within the rear cavity of the club head and in contact with the back of the club face. Such inserts may be composed of a polymer, such as TPU (thermoplastic urethane), TPR (thermoplastic rubber), or other material capable of damping vibrations caused by club face impact with a golf ball. Some iron golf club heads include a damping system, such as constrained layer damping assembly, which may consist of, for example, a medallion composed of TPU, plastic, or metal attached to the back of an iron cavity using viscoelastic tape.

Although current damping inserts/assemblies are intended to provide vibration damping and improve the feel of the club, golfers may prefer to have some form of clear indication that such vibration dampening is actually occurring, rather than simply relying on a designer's advertised claim. As such, one drawback to current damping inserts/assemblies is that they fail to provide a means for a golfer to quantify the efficacy of the damping insert/assembly. Instead, a golfer is left to either assume the validity of a manufacturer's claim that their golf club has an effective damping means or compare a golf club with a damping element to a golf club without such a damping element so as to determine improved feel, if any.

SUMMARY

The present invention provides a golf club head with a multifunctional damping assembly. More specifically, the damping assembly is configured to provide dampening of vibrational response of the club head upon impact of the club face with a golf ball, thereby improving the feel of the club. The damping assembly is further configured to provide information to a golfer in the form of visual and/or audible feedback indicative of one or more characteristics of a golf ball strike with the club face.

The damping assembly may include a damping element composed of an elastic material configured to dampen vibrations and/or deflections in the club head caused by club face impact with a golf ball. The damping assembly may further be configured to adjust in appearance and/or provide an audible alert in response to the club face impact with a golf ball. The change in appearance and/or audible alert may correlate to one or more characteristics of the golf ball strike, such as impact intensity, gradient of impact intensity along the club face, and/or location of impact on the club face, thereby providing a golfer with shot-specific data that can be useful in improving a golfer's game.

Accordingly, a damping assembly consistent with the present invention serves as a multifunctional element, configured to provide effective vibration damping to improve the feel of the club and further configured to provide a golfer with visual and/or audible indication as to timing, location, and amount of vibration damping occurring on the club face, thereby allowing the golfer to better understand how the club head functions and the quality of their golf ball strike, which is particularly beneficial in improving the golfer's game.

In certain aspects, the invention provides a golf club head having a body including a front portion, a rear portion, a topline, a sole, a heel, and a toe. The golf club head further includes a ball striking face disposed on the front portion of the club head body. The golf club head includes a damping assembly positioned adjacent to a rear surface of the ball striking face. The damping assembly is configured to dampen vibrations in the club head upon impact between the ball striking face and a golf ball. The damping assembly is further configured to provide at least one of a visual feedback and an audible feedback to a golfer indicative of one or more characteristics of the impact between the ball striking face and the golf ball.

In some embodiments, the one or more characteristics of the impact between the ball striking face and the golf ball are selected from the group consisting of magnitude of the impact, distribution of the impact on the ball striking face, location of the impact on the ball striking face, and a combination of at least two thereof.

In some embodiments, the damping assembly includes a damping material, at least a portion of which is in contact with the rear surface of the ball striking face and configured to receive and dissipate a deflection force imparted thereon from the ball striking face caused by the impact between the ball striking face and the golf ball. The damping material may include, but is not limited to, a bulk molding compound, rubber, urethane, polyurethane, a viscoelastic material, a thermoplastic or thermoset polymer, butadiene, polybutadiene, silicone, and a combination of at least two thereof.

In some embodiments, the damping material is configured to adjust in appearance in response to the deflection force to visually indicate impact between the ball striking face and the golf ball. For example, the damping material may include chromogenic polymer configured to transition between one of a plurality of colors in response to application of one of a plurality of predetermined forces imparted thereon, wherein each of the plurality of colors correlates to at least a magnitude of force of an associated predetermined force.

In some embodiments, the damping assembly may further include at least one piezoelectric sensor in contact with a portion of the rear surface of the ball striking face and configured to generate at least one electrical signal in response to receipt of the deflection force from the ball striking face, wherein the at least one electrical signal corresponds to the deflection force. The at least one piezoelectric sensor may be configured to generate one of a plurality of electrical signals in response to receipt of one of a plurality of predetermined forces imparted thereon, wherein each of the plurality of electrical signals correlates to at least a magnitude of force of an associated predetermined force.

In some embodiments, the damping material is configured to adjust in appearance in response to the application of the at least one electrical signal thereto. For example, the damping material may include chromogenic polymer configured to transition between one of a plurality of colors in response to application of an associated one of a plurality of electrical signals applied thereto, wherein each of the plurality of colors correlates to a magnitude of force of an associated electrical signal.

In some embodiments, the at least one piezoelectric sensor may be in electrical communication with a sound-emitting device, wherein the sound-emitting device is configured to emit a sound to audibly indicate impact between the ball striking face and the golf ball in response to receipt of the at least one electrical signal.

In some embodiments, the at least one piezoelectric sensor is in electrical communication with a light source, wherein the light source is configured to emit light to visually indicate impact between the ball striking face and the golf ball in response to the at least one electrical signal.

In some embodiments, the damping assembly may include a transceiver device configured to communicate and share impact data related to the at least one electrical signal with an external computing device, the external computing device configured to provide a golfer with shot data based the impact data. The external computing device may be configured to provide a visual display of shot data, wherein the shot data includes at least one of magnitude of impact between the ball striking face and the golf ball, distribution of impact on the ball striking face, location of impact on the ball striking face, and a combination of at least two thereof. For example, the external computing device may include a smartphone or tablet pc configured to provide a graphical rendering of the ball striking face of the club head and display shot data imposed on the ball striking face, thereby providing a visual indication to a golfer of how well they struck the ball based on magnitude of impact, distribution of impact, and/or location of impact on the ball striking face (e.g., off-center or sweet spot).

In other aspects, the invention provides a golf club head having a body including a front portion, a rear portion, a topline, a sole, a heel, and a toe. The golf club head further includes a ball striking face disposed on the front portion of the club head body. The golf club head includes a damping assembly positioned adjacent to a rear surface of the ball striking face. The damping assembly includes a damping material, at least a portion of which is in contact with the rear surface of the ball striking face and configured to receive and dissipate a deflection force imparted thereon from the ball striking face caused by an impact between the ball striking face and the golf ball. The damping assembly further includes at least one piezoelectric sensor in contact with a portion of the rear surface of the ball striking face and configured to generate at least one electrical signal in response to receipt the deflection force imparted thereon from the ball striking face. The at least one electrical signal includes impact data corresponding to the deflection force.

The damping assembly further includes at least one light-emitting diode in communication with the at least one piezoelectric sensor and configured to emit light to visually indicate the impact between the ball striking face and the golf ball in response to receipt of the at least one electrical signal. The at least one light-emitting diode is configured to emit light in a predetermined pattern so as to provide a visual indication of one or more characteristics of the impact between the ball striking face and the golf ball, the one or more characteristics including as least one of a magnitude of the impact, a distribution of the impact on the ball striking face, and location of the impact on the ball striking face. For example, in some embodiments, the intensity of light emitted from the light-emitting diode corresponds to the magnitude of impact between the ball striking face and the golf ball.

In other aspects, the invention provides a golf club head having a body including a front portion, a rear portion, a topline, a sole, a heel, and a toe. The golf club head further includes a ball striking face disposed on the front portion of the club head body. The golf club head includes a damping assembly positioned adjacent to a rear surface of the ball striking face. The damping assembly includes a damping material, at least a portion of which is in contact with the rear surface of the ball striking face and configured to receive and dissipate a deflection force imparted thereon from the ball striking face caused by the impact between the ball striking face and the golf ball. The damping assembly further includes at least one piezoelectric sensor in contact with a portion of the rear surface of the ball striking face and configured to generate at least one electrical signal having a predetermined voltage in response to receipt the deflection force imparted thereon from the ball striking face. The at least one electrical signal corresponds to the deflection force.

The damping material is a chromogenic polymer configured to transition between one of a plurality of colors in response to application of the at least one electrical signal thereto based, at least in part, on the predetermined voltage of the at least one electrical signal. For example, the color appearance of the chromogenic polymer provides a visual indication of one or more characteristics of the impact between the ball striking face and the golf ball. The one or more characteristics include as least one of a magnitude of the impact, a distribution of the impact on the ball striking face, and location of the impact on the ball striking face.

DETAILED DESCRIPTION

Figure 1:
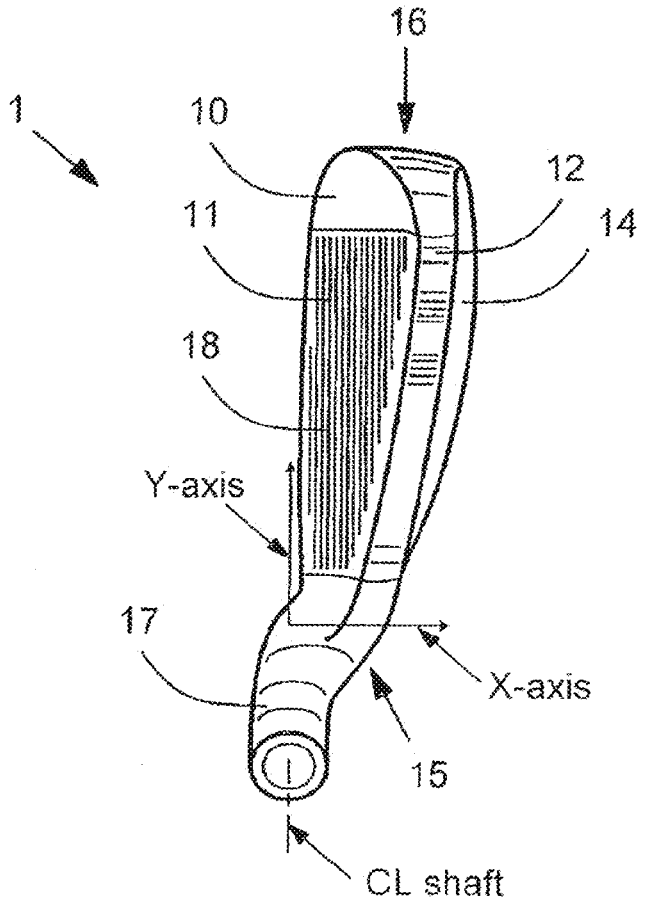
FIG. 1 is a top view of a golf club head of the present invention.

By way of overview, the present invention is generally directed to a golf club head with a multifunctional damping assembly. More specifically, the damping assembly is configured to provide dampening of vibrational response of the club head upon impact of the club face with a golf ball, thereby improving the feel of the club. The damping assembly is further configured to provide information to a golfer in the form of visual and/or audible feedback indicative of one or more characteristics of a golf ball strike with the club face.

The damping assembly may include a damping element composed of an elastic material configured to dampen vibrations and/or deflections in the club head caused by club face impact with a golf ball. The damping assembly may further be configured to adjust in appearance and/or provide an audible alert in response to the club face impact with a golf ball. The change in appearance and/or audible alert may correlate to one or more characteristics of the golf ball strike, such as impact intensity, gradient of impact intensity along the club face, and/or location of impact on the club face, thereby providing a golfer with shot-specific data that can be useful in improving a golfer's game.

Accordingly, a damping assembly consistent with the present invention serves as a multifunctional element, configured to provide effective vibration damping to improve the feel of the club and further configured to provide a golfer with visual and/or audible indication as to timing, location, and amount of vibration damping occurring on the club face, thereby allowing the golfer to better understand how the club head functions and the quality of their golf ball strike, which is particularly beneficial in improving the golfer's game.

Other than in the operating examples, or unless otherwise expressly specified, all of the numerical ranges, amounts, values, and percentages, such as those for amounts of materials, moments of inertia, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 2:
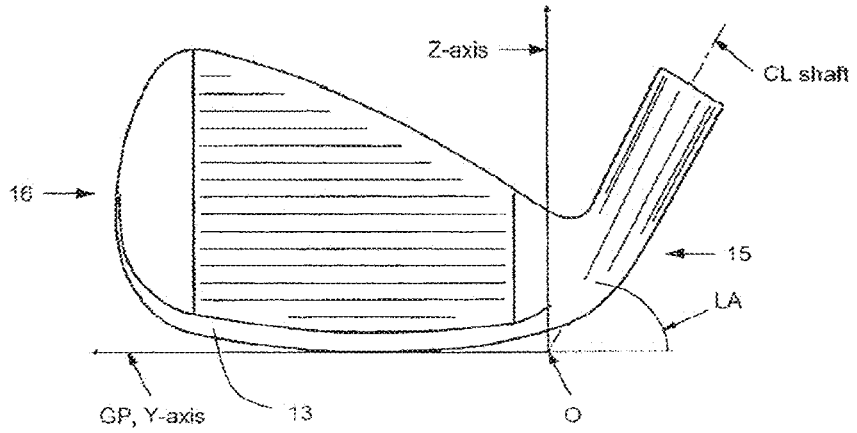
FIG. 2 is a front view of the golf club head of FIG. 1.

FIG. 1 is a top view of a golf club head 1 of the present invention, and FIG. 2 is a front view of the golf club head 1. The golf club head 1 includes a body 10, a front surface 11, a top line 12, a sole 13, a back 14, a heel 15, a toe 16, and a hosel 17. The striking face of the front surface 11 preferably contains grooves 18 therein. Various portions of the club head 1, such as the sole 13, may be unitary with the body 10 or may be separate bodies, such as inserts, coupled thereto. While the club head 1 is illustrated as an iron-type golf club head, the present invention may also pertain to other types of club heads, such as utility-type golf club heads or putter-type club heads.

FIGS. 1 and 2 define a convenient coordinate system to assist in understanding the orientation of the golf club head 1 and other terms discussed herein. An origin O is located at the intersection of the shaft centerline CLSH and the ground plane GP, which is defined at a predetermined angle from the shaft centerline CLSH, referred to as the lie angle LA, and tangent to the sole 13 at its lowest point. An X-axis is defined as a vector that is opposite in direction of the vector that is normal to the face 11 projected onto the ground plane GP. A Y-axis is defined as vector perpendicular to the X-axis and directed toward the toe 16. A Z-axis is defined as the cross product of the X-axis and the Y-axis.

Figure 3:
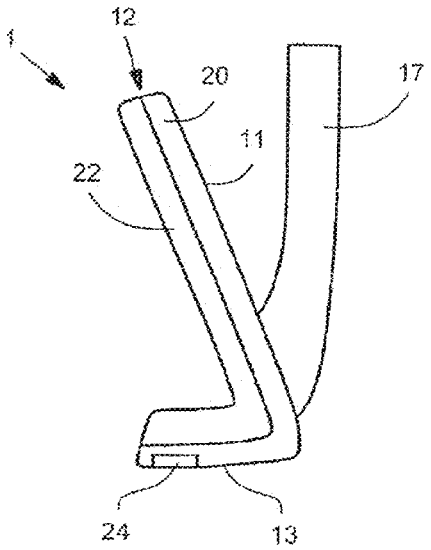
FIG. 3 is a cross-sectional view of a golf club head of the present invention.

As shown in FIG. 3, which illustrates a cross-sectional view of a golf club head 1 of the present invention, the club head 1 may comprise two main portions: a first body portion 20 and a second body portion 22. Optionally, a third body portion 24 may be included. The first body portion 20 preferably includes the hosel 17, the face 11, and at least a portion of the sole 13, and is formed of a material that is able to withstand forces imposed upon it during normal use of the golf club. Such forces may include those resulting from striking the golf ball and the playing surface. Similarly, the material should allow the lie angle, loft angle, and/or other club head attributes to be adjusted, such as by bending of the hosel 17. Preferred materials for the first body part 20 include ferrous alloy, titanium, titanium alloy, steel, and other metallic materials. This portion of the club head 1 may be formed by forging or casting as a single piece. Alternatively, this portion of the club head 1 may be formed by combining two or more separate pieces. For example, the face 11 may be a face insert that is coupled to a peripheral opening in the remaining portion of the first body portion 20.

The second body portion 22 is coupled to a rear surface of the first body portion 20, preferably opposite the face 11, and forms a middle portion of the club head 1. This portion of the club head 1 preferably is formed of a lightweight material. Thus, this portion of the club head 1 does not have a significant effect on the physical characteristics of the club head 1. Preferred materials for the second body part 22 include a bulk molding compound, rubber, urethane, polyurethane, a viscoelastic material, a thermoplastic or thermoset polymer, butadiene, polybutadiene, silicone, and combinations thereof. Through the use of these materials, the second body portion 22 may also function as a damper to diminish vibrations in the club head 1, including vibrations generated during an off-center hit.

According to one aspect of the invention, the second body portion 22 may have a density from approximately 0.5 g/cm$^3$ to approximately 5 g/cm$^3$, and is preferably less than the density of first body portion 20 by at least about 3 g/cm$^3$. For example, second body portion 22 may have a density between about 1.2 g/cm$^3$ to about 2 g/cm$^3$. Preferably, the density of second body portion 22 in this embodiment is less than 1.5 g/cm$^3$. Ideally, the density of second body portion 22 in this embodiment is less than 1.3 g/cm$^3$. In one embodiment, the density of second body portion 22 is less than the density of first body portion 20 by at least about 3 g/cm$^3$. In another embodiment, the density of the second body portion 22 is less than the density of first body portion 20 by at least about 4 g/cm$^3$.

The third body portion 24 is coupled to at least one of the first and second body portions 20, 22. The third body portion 24 may be a single piece, or it may be provided as a plurality of separate pieces that are attached to the first and/or second body portions 20, 22. The third body portion 24 preferably is positioned in the sole 13 or rear of the club head 1. This portion of the club head 1 preferably is formed of a dense, and more preferably very dense, material. High density materials are more effective for affecting mass and other properties of the club head 1, but stock alloys may alternatively be used. Preferred materials for this portion of the club head 1 include tungsten, and a tungsten alloy, including castable tungsten alloys. The density of the third body portion 24 preferably is greater than about 7.5 g/cm$^3$, and more preferably is about 10 g/cm$^3$ or greater. The density of the third body portion 24 should be greater than the density of the first body portion 20, which in turn should be greater than the density of the second body portion 22. The third body portion 24 can be provided in a variety of forms, such as in the form of a bar or one or more weight inserts. The third body portion 24 can be formed in a variety of manners, including by powdered metallurgy, casting, and forging. An exemplary mass range for the third body portion 24 is 2-30 grams. Alternatively, the third body portion 24 may comprise 10% or more of the overall club head weight.

This multi-part design allows the removal of unneeded mass (and weight), which can be redistributed to other, more beneficial locations of the club head 1. For example, this "freed" mass can be redistributed to do one or more of the following, while maintaining the desired club head weight and swingweight: increase the overall size of the club head 1, expand the size of the club head sweet spot, reposition the club head center of gravity (COG), and/or produce a greater moment of inertia (MOI) measured about either an axis parallel to the Y-axis or Z-axis passing through the COG. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits because less energy is lost during impact from club head twisting. Moving or rearranging mass to the club head perimeter enlarges the sweet spot and produces a more forgiving club. Moving as much mass as possible to the extreme outermost areas of the club head 1, such as the heel 15, the toe 16, or the sole 13, maximizes the opportunity to enlarge the sweet spot or produce a greater MOI.

The face portion of the first body portion 20 preferably is provided as thin as possible, while still maintaining sufficient structural integrity to withstand the forces incurred during normal use of the golf club and while still providing a good feel to the golf club. The second body part 22 provides for a traditional or otherwise desired appearance without adding appreciable weight. The second body part 22 also acts as a spacer, allowing the third body part 24 to be positioned at a desired distance rearward from the face 11, which in turn repositions the COG rearward and/or lower with respect to traditional club heads. By so positioning the center of gravity, the golf club is more forgiving. The COG position may be lowered further by removing unnecessary mass from the top line 12. Preferred methods of doing so are disclosed in U.S. Pat. Nos. 7,481,718; 7,524,250; and 8,480,506, the contents of each of which are incorporated herein by reference their entireties.

The third body portion 24 may be positioned so that a spring-mass damping system is formed. One such location is shown by the dashed lines of FIG. 4 and indicated by reference 24'. With the face 11 acting as the vibrating body, the second body portion 22 acts as the spring, and the third body portion 24 acts as the ground.

Figure 4:
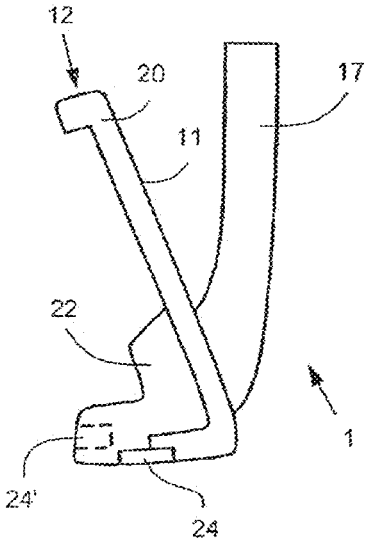
FIG. 4 is a cross-sectional view of a golf club head of the present invention.

In the illustrated embodiment of FIG. 3, the first body portion 20 includes the face 11 and the entire sole 13. The second body portion 22 is coupled to the rear surface of the first body portion 20, and extends all the way to the top line 12. The third body portion 24 is coupled to the first body portion 20 in the sole 13 of the club head 1. In this illustrated embodiment, the third body portion 24 is positioned only in the sole 13. Another embodiment is illustrated in FIG. 4. Here, the second body portion 22 extends only partially up the rear surface of the first body portion 20 and gives the club head 1 the appearance of a cavity back club head. In this embodiment, the sole 13 is formed by both the first and second body portions 20, 22, and the third body portion 24 is coupled to both the first and second body portions 20, 22.

The club head 1 may be assembled in a variety of manners. One preferred assembly method includes first forming the first and third body portions 20, 24, such as by casting or forging. These portions 20, 24 may then be placed in a mold, and then the material forming the second body part 22 inserted into the mold. Thus, the second body portion 22 is molded onto and/or around the first and third body portions 20, 24, creating the final club head shape. The second body part 22 may thus be bonded to either or both of the first and third body portions 20, 24. This is referred to as a co-molding process.

Figure 5:
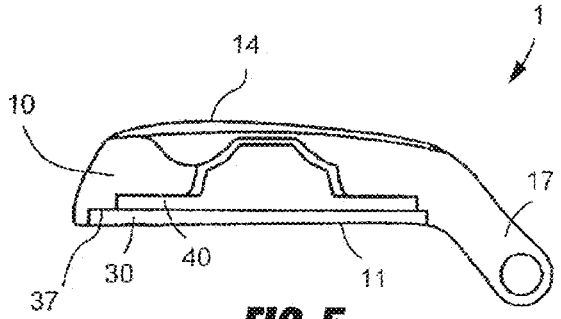
FIG. 5 is a top view of a golf club head of the present invention.

FIG. 5 is a top view of a golf club head 1 of the present invention. In this illustrated embodiment, the club head 1 includes a body 10 and a face insert 30 having a striking face 11. The body 10 defines a front opening 35, and has a ledge 37 adjacent the front opening 35. The ledge 37 may extend only partially around the perimeter of the front opening 35 or may be provided as several discrete sections, but preferably the ledge 37 extends completely around the perimeter of the face opening 35 (360°). The face insert 30 is coupled to the body 10 at the ledge 37. Preferably, the face insert 30 and the body 10 are in contact only along the ledge 37, thus minimizing the metal-to-metal contact between the two elements.

Figure 16:
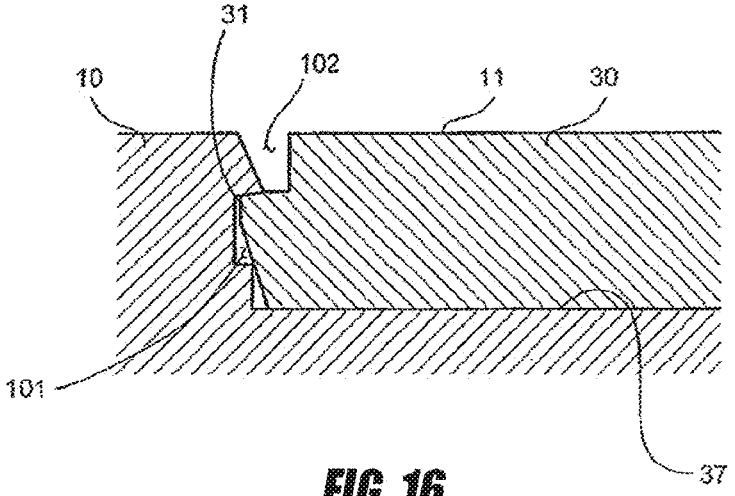
FIG. 16 is a partial cross-sectional view of a golf club head of the present invention illustrating one way of connecting a face insert to the club head body.

The face insert 30 to body 10 connection may be facilitated by the use of a groove and lock tab configuration. Such a configuration is shown in FIG. 16, which is a partial cross-sectional view of a golf club head of the present invention. The body 10 at ledge 37 defines a groove 101 therein that extends inward into the body 10. The face insert 30 includes a tab 31 corresponding to the groove 101. When the face insert 30 is inserted into the body opening 35, the tab 31 contacts the side wall of the ledge 37. When enough force is exerted, either or both of the tab 31 and the upper portion of the ledge 37 side wall deform, preferably elastically deform, allowing the face insert 30 to be inserted to its designed final position (such as being seated at ledge 37). When in this final position, the tab 31 passes the upper ledge wall portion and snaps out into place within the groove 101. Because the upper ledge wall portion now extends over the insert tab 31, the face insert 30 is retained in position. This tab-groove retention scheme could be provided around the entire perimeter of the face insert 30, or more preferably may be positioned in discrete locations around the insert perimeter. It is possible that instead of the tab 31 being part of the face insert 30 and the groove being defined by the body 10, the opposite construction, wherein the body 10 contains a tab and the face insert 30 contains a corresponding groove, may also be used. Furthermore, these varying constructions could both be employed on a single club head 1.

Figure 17:
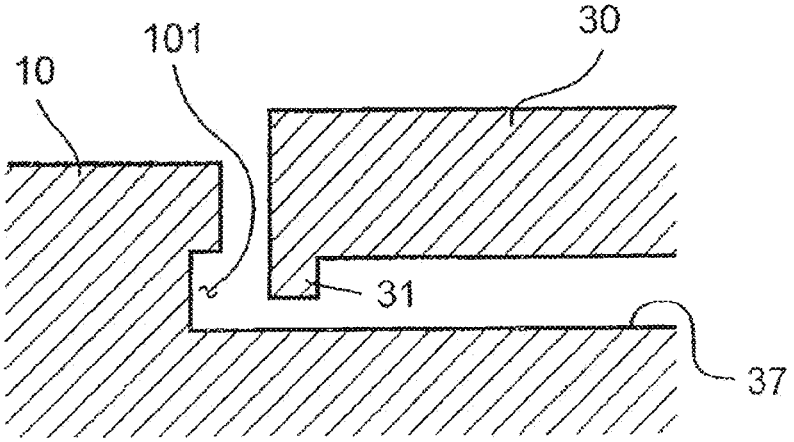
FIG. 17 is a partial cross-sectional view of a golf club head of the present invention illustrating another way of connecting a face insert to the club head body.

FIG. 17 illustrates an alternate groove and lock tab configuration. In this illustrated embodiment, in which the face insert 30 has not yet been coupled to the club head body 10, the face insert 30 contains tabs 31 extending rearward from perimeter edges thereof. The club head body 10 contains grooves 101 extending in a direction substantially perpendicular to the ledge 37, such as toward the heel 15 and toe 16. When the face insert 30 is coupled to the club head body 10, tabs 31 are plastically deformed into the corresponding grooves, locking the face insert 30 to the body 10.

An adhesive or other joining agent may be used to further ensure that the face insert 30 is retained as intended. The face insert 30 and/or upper ledge wall portion may be designed to define a groove 102 around the face insert 30 to provide a run-off or collection volume for any excess adhesive. This not only provides a pleasing aesthetic appearance in the finished golf club, but also beneficially reduces assembly and manufacturing time. Exemplary ways of creating the groove 102 include by angling the upper portion of the ledge side wall and/or by stepping-in the outer portion of the face insert 30.

Figure 13:
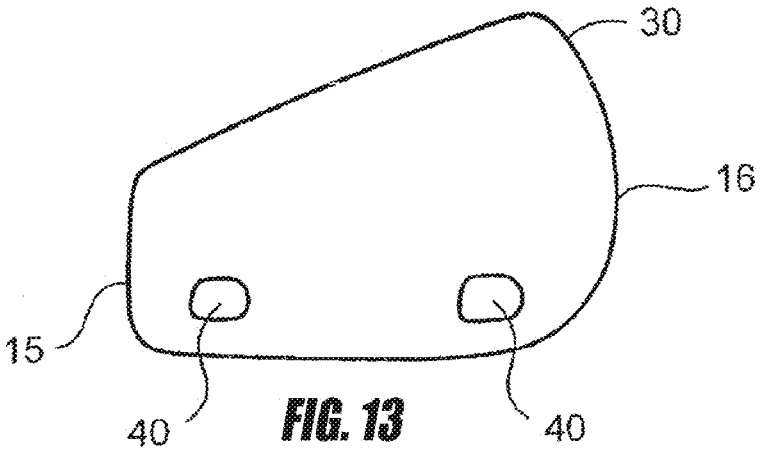
FIG. 13 is a rear view of a face insert with dampers positioned to contact its rear surface at heel and toe portions thereof.
Figure 14:
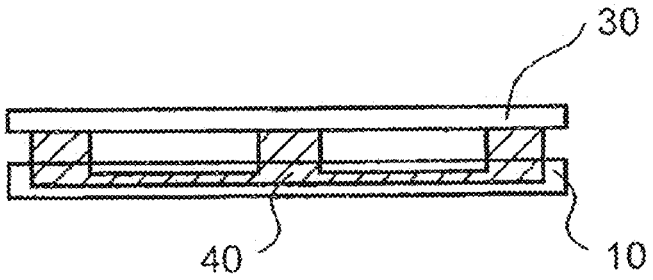
FIG. 14 is a cross-sectional top view of a damping member having a plurality of fingers extending outward to contact the rear surface of the face at heel, toe, and central portions thereof.

A damping member 40 is positioned intermediate the body 10 and the face insert 30. As the face 30 deflects during use, the deflection forces are imparted to the damping member 40, which dissipates such forces and reduces the resulting vibration. This lessens and may eliminate vibrations—such as those incurred during an off-center hit—being transmitted through the club head and shaft to the golfer, resulting in a club with better feel and a more enjoyable experience to the golfer. Preferably, the damping member 40 is held in compression between the body 10 and the face 30, which enhances the effectiveness of the vibration damping aspects of the damping insert 40. Preferably, the damping member 40 is positioned such that it is in contact with a rear surface of the face insert 30 opposite the club head sweet spot. The damping member 40 may contact the rear surface of the face insert 30 at other locations, such as the heel 15 or toe 16 or top line 12, in addition to or instead of at the sweet spot. FIG. 13 illustrates a rear view of a face insert 30 with dampers 40 positioned to contact the rear surface of the face 30 at heel 15 and toe 16 portions thereof. FIG. 14 illustrates a cross-sectional top view of a damping member 40 having a plurality of fingers extending outward to contact the rear surface of the face 30 at heel 15, toe 16, and central portions thereof. It should be noted that while the entire damping member 40 is shown in FIG. 14, a portion of it would actually be blocked from view by the body 10. Depending upon the vertical placement of the damping member 40, the central finger may be in contact with the face insert 30 opposite the club head sweet spot. Recesses, indentations, or the like may be provided in the rear surface of the face insert 30 to position and help retain the damping members 40 in place. It is beneficial to provide a damping member 40 at these locations because impacts (such as with a golf ball) in these areas create more vibration than center impacts by virtue of the impact being farther from the club head center of percussion. As shown for example in FIG. 14, there may be a gap, such as due to an undercut, making the damping member 40 visible in the finished club head. Thus, the damping member(s) 40 may be "free floating" with no portion of the member(s) 40 in contact with the face 30 being constrained against expansion due to compression. In other words, no portion of the club head body 10 is in contact with the damping member(s) 40 at its distal end adjacent to and abutting the face 30; the damping member(s) 40 is open 360° to the environment at its distal end. This may enhance their vibration damping effect. As further shown in FIG. 14, the damping member(s) 40 may take the form of a plurality of fingers of suspended, compressed damping material contacting the rear surface of the face 30.

Figure 6:
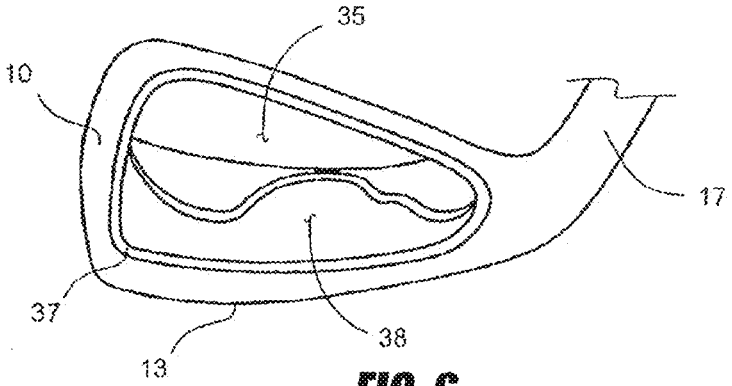
FIG. 6 is a front view of the body member of the golf club head of FIG. 5.

FIG. 6 is a front view of the body 10 of the golf club head 1 of FIG. 5 without the face insert 30 or damping member 40 in place. Through the front opening 35, it can be seen that the body 10 preferably includes an undercut 38. Inclusion of the undercut 38 removes additional material from the club head body 10, further enhancing the weight distribution, COG location, MOI, and other benefits discussed above. The undercut can extend 360° around the face perimeter, or can extend to any desired fraction thereof, such as 90° or less. In the illustrated embodiment of FIG. 6, the undercut 38 extends from a mid-heel area to a mid-toe area. The undercut preferably extends toward the sole 13 in a lower portion of the body 10. Preferably, the damping member 40 is positioned to at least partially fill the undercut 38.

In one preferred embodiment, the COG is located 17.5 mm or less above the sole 13. Such a COG location is beneficial because a lower COG facilitates getting the golf ball airborne upon being struck during a golf swing. Also, the MOI measured about a vertical axis passing through the club head COG when grounded at the address position is preferably 2750 $g \cdot cm^2$ or greater. This measurement reflects a stable, forgiving club head.

These attributes may be related conveniently through the expression of a ratio. Thus, using these measurements, the golf club head has a MOI-to-COG ratio of approximately 1600 g·cm or greater. As used herein, "MOI-to-COG ratio" refers to the MOI about a vertical axis passing the club head COG when grounded at the address position divided by the COG distance above the sole 13.

In certain clubs, it may be desirable to raise the center of gravity. For example, clubs with a high loft angle such short irons (9 iron-wedges) may benefit from a higher center of gravity than other clubs in a set. Without being bound to any particular theory, a club with a high center of gravity is likely to impart more spin to the golf ball due to vertical gear effects. This is because an impact made below the center of gravity will increase the spin rate of the ball to help maximize trajectory and distance. The ability to generate more ball spin for the short irons is an important factor in the golfer's ability to control both the distance of the golf shot, and the distance the ball will roll after the ball hits the green. For example, a short iron or wedge may have a vertical center of gravity $CG_Z$ that is greater than about 17 mm. Preferably, a short iron has a vertical center of gravity $CG_Z$ that is greater than about 18 mm. In one embodiment, a short iron has a vertical center of gravity $CG_Z$ that is greater than about 20 mm.

Without being bound to any particular theory, adding mass to the top line raises the center of gravity and the moment of inertia of the club head. In one embodiment, mass is added to the top line in the form of one or more high density inserts. Suitable materials for the high density insert include, but are not limited to, powdered tungsten, a tungsten loaded polymer, and other powdered metal polymer combinations.

According to another aspect of the invention, the center of gravity may be raised for certain clubs in a set by reducing the size of the third body portion, which is located near the sole. In one embodiment, the third body portion comprises greater than about 10% of the overall mass of the club head. In order to achieve a golf club head with a higher center of gravity, the weight members may be reduced in size so that the weight members comprise less than about 10% of the total mass of the club.

In one embodiment of the invention, the third body portion 24 may be comprised of a different material for certain clubs in a set. For example, the long irons (3-6 iron) may have a third body portion 24 that is comprised of a material with a density greater than about 10 g/cm$^3$. Alternatively, the middle and short irons (7-iron through wedges) may have a third body portion 24 comprising a material with a density of less than about 10 g/cm$^3$.

In the alternative, an impact made high on the face above the center of gravity will create a higher launch angle, and the vertical gear effect will actually cause the ball to spin less. This can produce greater distance as the ball is subject to less lift or drag that a higher spin creates. As such, it may be desirable to lower the center of gravity for the lower loft angle irons (3-6). For example, a long iron may have a vertical center of gravity $CG_Z$ that is less than about 17.5 mm. In one embodiment, the center of gravity $CG_Z$ is less than about 17 mm. In another embodiment, the center of gravity $CG_Z$ is less than about 16.5 mm.

Lowering the center of gravity may be achieved by removing material from the top line, as discussed and incorporated above. Alternatively, the mass of third body portion 24 may be increased to comprise greater than about 10% of the total mass of the club head. In one embodiment, the mass of third body portion 24 comprises greater than about 15% of the total mass of the club head.

In another embodiment, the sole of the club head can be made wider in a face to back direction. A wider sole will result in more mass located near the sole, which lowers the center of gravity of the club head. In the alternative, the sole of the club head may be made thinner in a face to back direction. The thinner sole results in a club head with less mass located near the sole of the club head, which raises the center of gravity of the club head.

According to one aspect of the invention, the center of gravity is altered by varying the thickness of the face or a face insert. For example, a thick face or face insert may result in a higher center of gravity. In particular, a striking face or face insert with a thicker lower portion and a thin upper portion may result in a lower center of gravity. In addition, a thin face or face insert may result in a lower center of gravity.

In one embodiment, the size of a cavity located in the back of the club head may be varied to affect the center of gravity location. For example, the cavity may remove more material from a lower portion of the club head than the upper portion of the club head, which results in a higher center of gravity. Alternatively, the cavity may remove more material from the upper portion of the club head, which results in a lower center of gravity.

In another embodiment, the height of the club head may be increased or decreased to alter the center of gravity of the club head. For example, increasing the height of the club head adds material to the club head, which raises the center of gravity. Likewise, lowering the height of the club head will remove material from the top of the club thereby lowering the center of gravity.

Any of the methods described above may be combined to further manipulate the location of the vertical center of gravity.

As previously described, the golf club head of the present invention has a moment of inertia $I_{ZZ}$ about an axis that passes through the center of gravity and is parallel to the z-axis (as shown in FIG. 2). This axis of rotation relates to the forgiveness of an iron in the heel to toe rotation about the center of gravity. Thus, a higher $I_{ZZ}$ indicates a greater resistance to twisting on off-center hits, resulting in more forgiveness. Regardless of the location of the vertical center of gravity, the $I_{ZZ}$ for the present invention is preferably greater than about 2800 g·cm$^2$. In one embodiment the moment of inertia $I_{ZZ}$ for the present invention is preferably greater than about 2900 g·cm$^2$. In one embodiment, the moment of inertia $I_{ZZ}$ is greater than 3000 g·cm$^2$.

In addition, the moment of inertia $I_{ZZ}$ for a club head of the present invention may be related to the vertical center of gravity ($CG_Z$) by the following equation:

$$I_{ZZ} \geq CG_Z * 170 \quad (1)$$

where $I_{ZZ}$ is in g·cm$^2$ and $CG_Z$ is measured in millimeters (mm) in the z-direction.

In one embodiment, the club head satisfies the following relationship between the density of the second body portion the moment of inertia $I_{ZZ}$, and the center of gravity $CG_Z$:

$$I_{ZZ} \leq CG_Z * D * 123 \quad (2)$$

where D is the density of the second body portion in g/cm$^3$, $I_{ZZ}$ is greater than 2800 and is in g·cm$^2$, and $CG_Z$ is measured in millimeters (mm) in the z-direction.

In another embodiment, the club head satisfies the following relationship between the density of the third body portion, the moment of inertia $I_{ZZ}$, and the center of gravity $CG_Z$:

$$I_{ZZ} \geq CG_Z * D * 17 \quad (3)$$

where D is the density of the second body portion in g/cm$^3$, $I_{ZZ}$ is greater than 2800 and is in g·cm$^2$, and $CG_Z$ is measured in millimeters (mm) in the z-direction.

According to one aspect of the invention, the club head that satisfies any of equations 1-3 above has a loft angle of between about 25° to about 32°.

A set of club heads including at least one club head with a low center of gravity and at least one club head with a higher center of gravity will preferably have clubs in the set that meet the relationship of all three equations. For example, a set of clubs may include at least one club head with a vertical center of gravity that is greater than about 17 mm. Preferably, at least one club head in the set has a center of gravity that is greater than about 18 mm. In one embodiment, at least one club head in the set has a vertical center of gravity $CG_Z$ that is greater than about 20 mm. In addition, at least one club head in the set has a vertical center of gravity $CG_Z$ that is less than about 17 mm. In another embodiment, at least one club has a center of gravity $CG_Z$ that is less than about 16.5 mm. Preferably, all of the clubs in the set have a moment of inertia $I_{ZZ}$ that is preferably greater than about 2800 g·cm$^2$. In addition, at least one club in the set preferably has a moment of inertia $I_{ZZ}$ greater than 3000 g·cm$^2$.

Preferred materials for the body 10 and the face insert 30 are discussed above with respect to the first body portion 20, and preferred materials for the damping member 40 are discussed above with respect to second body part 22. Additionally, when a face insert is used, it preferably may comprise high strength steel or a metal matrix composite material, a high strength aluminum, or titanium. A high strength steel typically means steels other than mild low-carbon steels. A metal matrix composite (MMC) material is a type of composite material with at least two constituent parts, one being a metal. The other material may be a different metal or another material, such as a ceramic or organic compound. These materials have high strength-toweight ratios that allow the face insert 30 to be lighter than a standard face, further freeing mass to be beneficially repositioned on the club head 1 and further enhancing the playability of the resulting golf club. It should be noted that when a face insert is used, material selection is not limited by such constraints as a requirement for malleability (such as is often the case when choosing materials for the body and hosel). If a dissimilar material with respect to the body 10 is chosen for the face insert 30 such that welding is not a readily available coupling method, brazing, explosion welding, and/or crimping may be used to couple the face insert 30 to the body 10.

The face insert 30 may be formed of titanium or a titanium alloy. This face insert 30 may be used in conjunction with a stainless steel body 10, an exemplary stainless steel being 17-4. As these two materials are not readily joined by welding, crimping is a preferred joining method. This typically includes formation of a raised edge along all or portions of the face opening perimeter, which is mechanically deformed after the placement of face insert, locking the two together. The face insert may be beveled or otherwise formed to facilitate crimping. One or more machining/polishing steps may be performed to ensure that the strike face is smooth. Alternatively, the face insert 30 may be formed of a stainless steel, which allows the face insert 30 and the body 10 to be readily joined via welding. One preferred material is 1770 stainless steel alloy. As this face insert material is more dense than titanium or titanium alloy, the resulting face insert 30-body 10 combination has an increased weight. This may be addressed by increasing the size (i.e., the volume) of the undercut 38, such that the overall size and weight of the club heads are the same.

This embodiment of the club head 1 may be assembled in a variety of manners. One preferred method of assembly includes casting, forging, or otherwise forming the body 10 and the face insert 30 (in separate processes). The face insert 30 may be formed such that it has one or more raised areas 32 on a rear surface thereof. (See FIG. 7, which is a side view of the golf club head 1 of FIG. 5 when cut (substantially) in half approximately through a vertical centerline of the club head 1.) These raised areas 32 are in at least partial contact with the damping member 40 when the club head 1 is assembled, and act as guide walls to help orient the damping member 40 into the desired proper position. The damping member 40 may be molded with the body 10 and face insert 30 in place as discussed above. Alternatively, the damping member is positioned in the desired location within the body 10 before the face insert 30 is coupled to the ledge 37 or the damping member 40 is put into place after the face 30 is attached to the body 10. Preferably, the damping member 40 is larger than the resulting volume of its location in the assembled club head 1. Thus, when the face insert 30 is positioned along the ledge 37 within the face opening 35, the damping member 40 is compressed, and is retained in a state of compression in the assembled club head 1 to further enhance vibration dissipation.

Figure 8A:
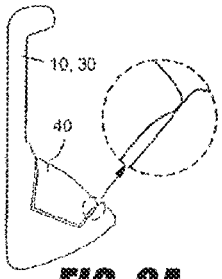
FIGS. 8A, 8B, and 8C illustrate additional methods of connection the damping member to the club face and/or body of the club head of FIG. 5.
Figure 8B:
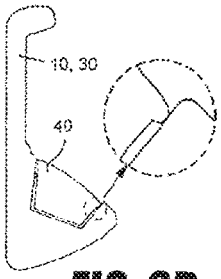
Figure 8C:
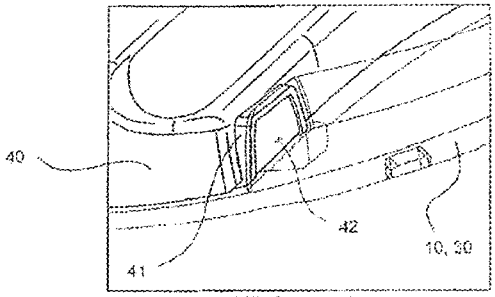

FIGS. 8A, 8B, and 8C illustrate additional methods of connecting the damping member 40 to the club face 30 and/or body 10. In the illustrated embodiments of FIGS. 8A and 8B, the damping member 40 flares outward at its upper end. This increases the frictional forces between it and the face 30 and/or the body 10, substantially locking the damping member 40 in place. It should be noted that the spaces or empty volumes shown in FIGS. 8A and 8B are provided for purposes of illustration and may likely not be present in the assembled club head 1. In the illustrated embodiment of FIG. 8C, the damping member 40 is provided with a projection 41 and the face insert 30 and/or body 10 is provided with a corresponding chamber 42 into which the projection 41 is retained, substantially locking the damping member 40 in place. While only one projection 41 and corresponding chamber 42 are shown, two or more such projections-chambers 41, 42 can be used.

The damping member 40 may comprises a plurality of materials. For example, the damping member 40 may include a first material in contact with the face insert 30 and a second material in contact with the body 10. The materials of the damping member may have varying physical characteristics, such as the first material (adjacent the face insert 30) being harder than the second material (adjacent the body 10). The differing materials may be provided in layer form, with the layers joined together in known fashion, such as through use of an adhesive or bonding.

As described in greater detail herein, the damping member 40 may comprise a material that changes appearance when subjected to a predetermined load. This would provide the golfer with visual confirmation of the damping at work. Further description of such embodiments of a damping member 40 configured to change appearance is shown in FIGS. 21-34.

Figure 7:
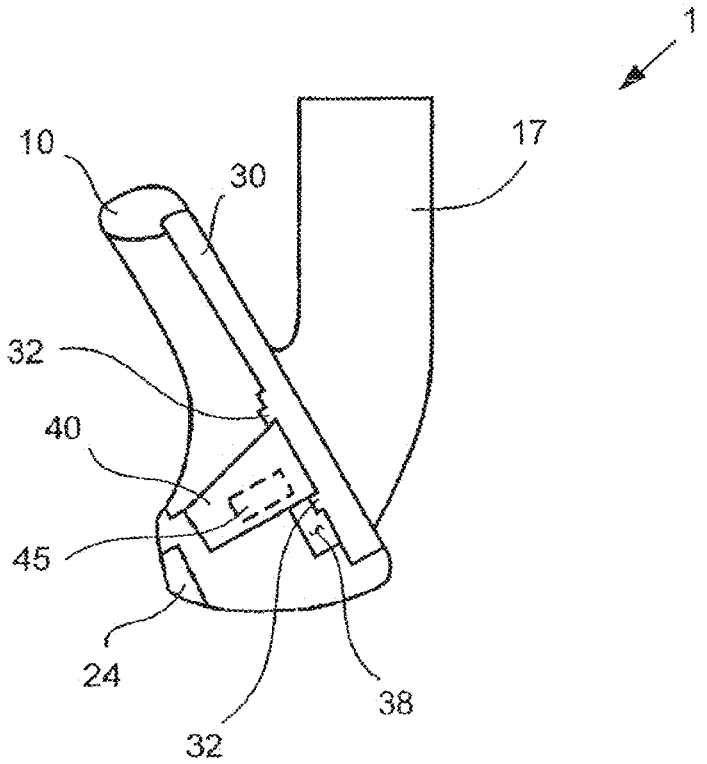
FIG. 7 is a side view of the golf club head of FIG. 5 when cut in half.

As shown in FIG. 7, the club head 1 may include a weight member 24, which is discussed above in terms of the third body portion 24. The weight member 24 may be cast or forged in place during formation of the body 10, or may it may be added after the body 10 has been formed, such as by welding or swaging it in place. As shown by the dashed lines in FIG. 7, the damping member 40 may be provided with one or more weight members 45 having similar properties to the weight member 24. The weight member(s) 45 may be encapsulated within the damping member 40. An exemplary mass range for both weight members 24, 45 is 2-30 grams. Alternatively, the weight members 24, 45 may comprise 10% or more of the overall club head weight, individually or collectively. Upon contact with a golf ball, the encapsulated weight 45 exerts a force on the material of the damping member 40, causing it to deform. This deformation further dissipates vibrations generated during use of the golf club. Preferably, the damping member 40, with or without inclusion of the weight member 45, is positioned between the body 10 and the face insert 30 such that the loading on it will be consistent, regardless of the golf ball impact location on the striking face 11.

Figure 9:
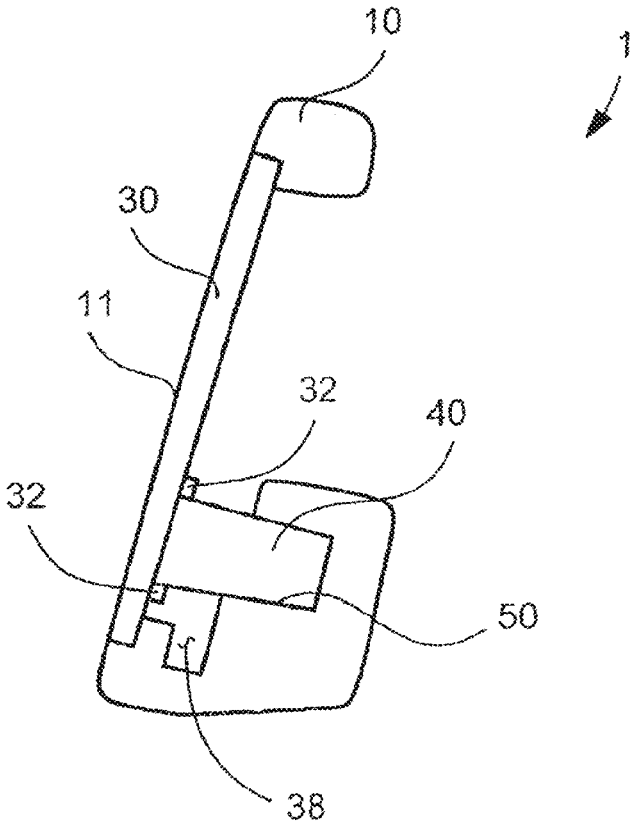
FIG. 9 is a cross-sectional view through a golf club head of the present invention.

FIG. 9 is a cross-sectional view through a golf club head 1 of the present invention. In this illustrated embodiment, guides 32 hold the damping member 40 in place adjacent the rear surface of the face insert 30, and the rear portion of the body 10 includes a chamber 50 into which the rear portion of the damping member 40 is positioned. In this manner, it is not necessary to couple the damping member 40 to the face insert 30 or the body 10. Inclusion of the guides 32 is optional, as the damping member 40 may be retained in the desired position by the chamber 50 alone. Additionally, the contacts between the damping member 40 and the body 10 and/or the face insert 30 can be lubricated so that frictional forces are minimized. If a weight member is used within or adjacent to the damping member 40 (an example of the latter being inclusion of a separate weight member adjacent a rear surface of the damping member 40 or a separate weight member intermediate layers of damping material), the contacts between the weight member and the damping member 40 can also be lubricated to further reduce frictional forces.

Figure 10:
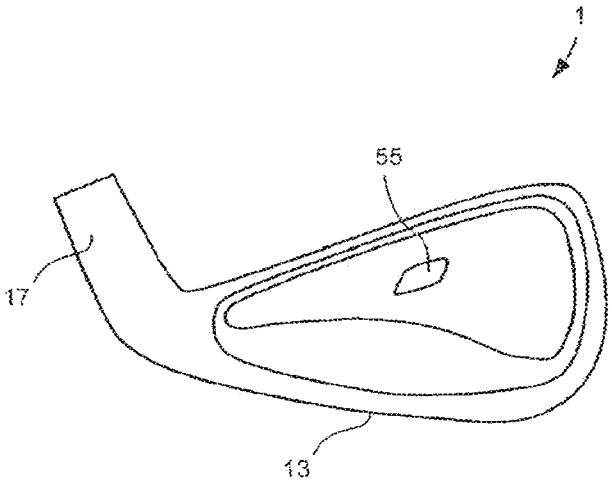
FIG. 10 is a rear view of a golf club head of the present invention.

FIG. 10 is a rear view of a golf club head 1 of the present invention. The rear surface of the face includes a projection 55 extending outward from a rear surface thereof. In the illustrated embodiment, the club head 1 is a cavity back and the projection 55 is located within the cavity, such that it is visible in the assembled club head 1. Preferably, the projection 55 has the shape of a rhombus. The benefits of including the projection 55 are discussed in U.S. Pat. Nos. 7,029,403; 7,704,162; 7,169,059; 7,367,899; 7,261,643; and 7,207,898, the contents of each of which are incorporated herein by reference their entireties. The rear surface of the face preferably may be machined to form the projection 55 and/or other features.

As discussed above, incorporating a face plate 30 formed of a relatively lightweight material provides certain benefits to the resulting golf club. Aluminum (including aluminum alloys) is one such lightweight material. M-9, a scandium 7000-series alloy, is one preferred aluminum alloy. Using a face insert 30 that comprises aluminum with a steel body 10, however, can lead to galvanic corrosion and, ultimately, catastrophic failure of the golf club. To realize the benefits both of using a face insert 30 comprising aluminum and a body 10 comprising steel (such as a stainless steel), without being susceptible to galvanic corrosion, a layered face insert 30 may be used.

Figure 11:
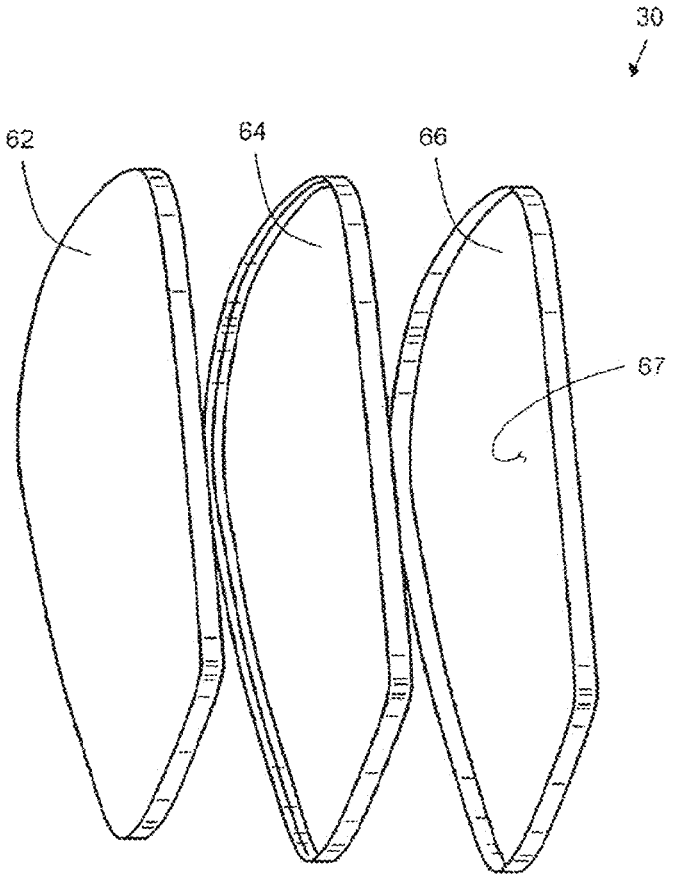
FIG. 11 is a perspective view of a layered face insert of the present invention.

FIG. 11 illustrates such a layered face insert 30. There are three main components to this layered face insert 30. A first layer 62 is provided, and preferably is formed of a high strength, lightweight metallic (preferably an aluminum alloy) or ceramic material. This first layer 62 includes a surface that functions as the strike face 11. (While no grooves 18 are shown in the illustrated embodiment of FIG. 11 for the sake of clarity, it should be recognized that grooves of varying design can be included.) The first layer 62 is lighter than typical face inserts for the beneficial reasons discussed above.

Figure 12:
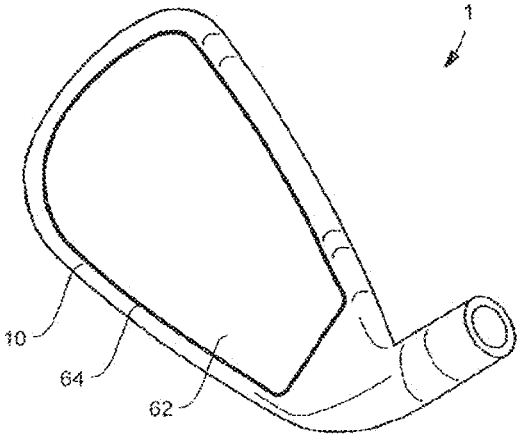
FIG. 12 is a front view of a golf club head of the present invention employing the layered face insert of FIG. 11.

A second layer 64 is provided to the rear of and abutting the first layer 62. This layer 64 is formed of a lightweight material, such as those discussed above with respect to the second body part 22. This layer 64 provides the desired sizing and damping characteristics as discussed above. The first and second layers 62, 64 may be joined together, such as via bonding. This second layer 64 may contain a lip extending outward around its perimeter, thus forming a cavity, into which the first layer 62 may be retained. In this manner, the metallic material of the first layer 62 may be isolated from the material of the club head body 10, and galvanic electrical flow between the club head body 10 and the metallic portion(s) of the face insert 30 is prevented. The third main component of the layered face insert 30 is a foil 66. The foil 66 is very thin and may be formed of a variety of materials, including materials that act to prevent galvanic corrosion. The foil 66 includes a pocket or cavity 67 sized to envelop the first and second layers 62, 64. The foil 66 may be joined to the first and second layer 62, 64 combination via an adhesive or other means, or simply by being pressed or otherwise compressed against the rear and perimeter surfaces of the second layer 64. The layered face insert is then joined to the club head body 10 in known manner, such as by bonding and/or crimping. FIG. 12 shows a front view of a golf club head 1 employing the layered face insert 30. Inclusion of the foil 66 is optional.

Other means for preventing galvanic corrosion may also be used. These may include coating the face insert 30 or the corresponding structure of the body 10, such as ledge 37. Preferred coating methods include anodizing, hard anodizing, ion plating, and nickel plating. These alternate corrosion prevention means may be used in conjunction with or alternatively to the three-part face insert construction described herein.

The rear surface of the second layer 64 may be provided with a contoured surface. One such surface being, for example, a logo or other manufacturer indicium. In certain embodiments, the rear surface of the face insert 30 is visible. As the foil layer 66 is very thin and mated to the rear surface of the second layer 64, the textured rear surface of the second layer 64 is visible in these embodiments. The foil 66 may be colored or otherwise decorated to enhance the visibility of the logo, indicium, or other texture of the second layer 64. If the foil 66 is colored or otherwise decorated prior to be joined to the layers 62, 64, the textured surface can be colored and otherwise enhanced without costly and time consuming processes, such as paint filling, that are typically required. A plurality of indicia, examples including manufacturer and product line identifiers, preferably may be included in this manner.

Figure 15:
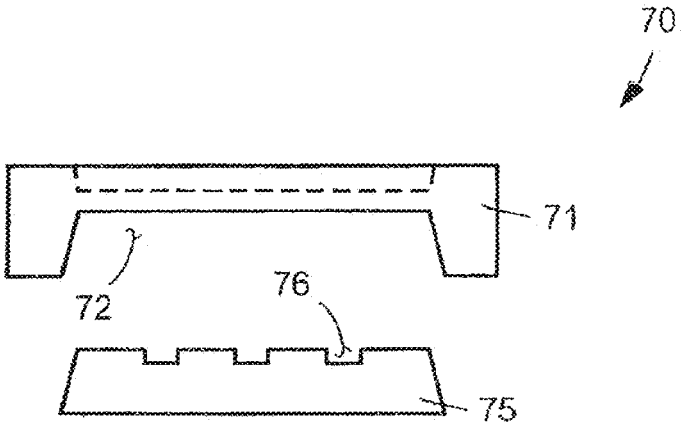
FIG. 15 is an exploded side view of a multi-part medallion of the present invention.

Alternatively or in addition to using a contoured rear second layer surface and the foil 66 to provide indicia, a medallion may be used. An exploded side view of a preferred medallion 70 is shown in FIG. 15. This medallion 70 includes a base member 71 formed of a resilient material, such as those discussed above with respect to the damping members 40 and the second body part 22. Either of these previously discussed components may have the additional function of serving as the base member 71. The medallion 70 further includes an indicia member 75, which may be formed from a variety of materials, such as a low density polycarbonate resin, a low density metallic material, or acrylonitrile butadiene styrene (ABS). The main requirement for the indicia member 75 material is that it exhibit some amount of rigidity so that the indicia is not distorted. The indicia member 75 may be hollow. The indicia member 75 includes a top surface that may contain one or more grooves 76. These grooves 76 may be used to form the indicia, and they may be paint-filled. The indicia member 75—including the grooves 76, if present—can be formed in a variety of manners. One preferred manner is electroforming, which is a readily repeatable, high-tolerance process that results in a part with a high surface finish. This process is readily used with complex configurations, and the resulting part is not subject to shrinkage and distortion associated with other forming techniques.

Figure 18:
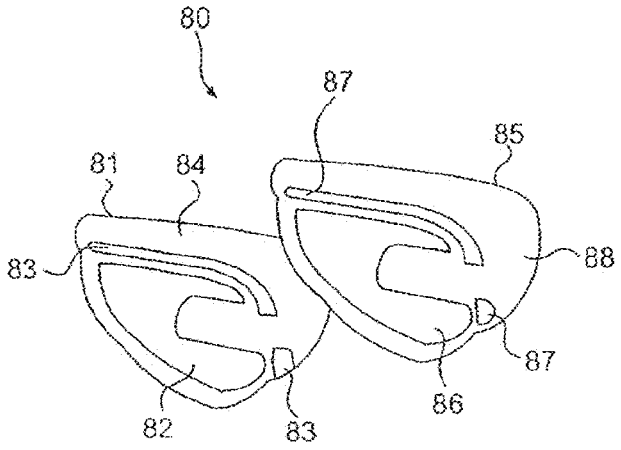
FIG. 18 shows an exploded view of an insert assembly for use with a golf club head of the present invention.
Figure 19:
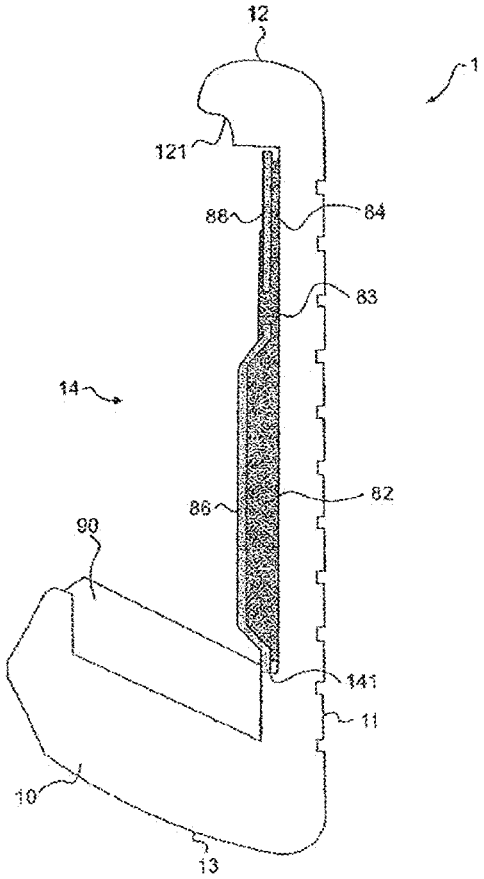
FIG. 19 shows a cross-sectional view of a golf club head of the present invention employing an insert assembly of FIG. 18.

The base member 71 defines a chamber 72 into which the indicia member 75 is positioned and retained. Adhesive, epoxy, and the like may be used to join the base member 71 and the indicia member 75. Corresponding walls of the chamber 72 and the indicia member 75 may be sloped to lock the indicia member 75 in place within the chamber 72. As indicated by the dashed lines in FIG. 15, the base member 71 contains an opening through which the indicia member 75—including the paint-filled grooves 76, if present—can be viewed. The indicia member 75 may extend through the opening such that its upper surface is flush with the base member upper surface. Alternatively, the indicia member 75 does not extend completely to the base member upper surface; rather, there may be a void between the upper surfaces of the base member 71 and the indicia member 75. This void can be left empty, or it may be filled with a clear material, such as a transparent polycarbonate, which will act to protect the indicia. A multi-piece and multi-material insert assembly may be included on the rear surface of the front wall, opposite the striking face 11. FIG. 18 shows an exploded view of such an insert assembly 80, and FIG. 19 shows a cross-sectional view of a golf club head 1 employing such an insert assembly 80. The insert assembly 80 includes two major portions. A first insert 81 of the assembly 80 has varying thickness, and is coupled to the rear surface of the front wall. A second insert 85 of the assembly 80 is placed over the first insert 81 and has a substantially constant thickness, but is contoured to correspond to the varying thickness of the first insert 81.

The first insert 81 is formed of a viscoelastic material, such as polyurethane, to damp vibrations generated during use of the resulting golf club, such as those resulting when a golf ball is struck at a location other than the sweet spot or center of percussion. The first insert 81 has varying thickness, and three regions of different thickness are shown in the illustrated embodiment. The first insert 81 may cover substantially all of the rear surface or only select portions thereof. A first region 82 has the greatest thickness and preferably constitutes a major portion of the insert 81. That is, the first region 82 preferably is the largest of the regions of the first insert 81. When coupled to the club head 1, this first region 82 is positioned low on the rear surface towards the sole wall, and thus is positioned opposite that portion of the striking face 11 that forms the intended hitting region of the club head 1. That is, the portion of the striking face 11 that is intended to contact the golf ball during a golf swing. Thus, the hitting region includes the sweet spot of the club head and a zone surrounding the sweet spot. Golfers strive to contact the golf ball within the hitting region for desired golf shots with preferred trajectory, ball flight, and shot distance. The thickness of this region 82 preferably is from 0.07 to 0.09 inch, and more preferably approximately 0.08 inch. The first region 82 preferably may comprise approximately 40-75% of surface area, and in a more preferred embodiment comprises approximately 65% of the rear surface area.

A second region 83 of the first insert 81 has intermediate thickness, and substantially surrounds the first region 82. Thus, the second region 83 substantially surrounds a region on the rear surface of the face wall opposite, or corresponding to, the hitting region of the striking face 11. As shown, the second region preferably extends from an upper heel area to a lower toe area of the rear surface, arcing or curving across the rear surface. The thickness of this region 83 preferably is from 0.03 to 0.05 inch, and more preferably approximately 0.04 inch. The second region thickness preferably is also approximately half the thickness of the first region 82, meaning within ±0.005 inch or within normal manufacturing tolerances. Alternatively, the thickness of the first region 82 is at least two times that of the second region 83, and may be from two to four times the thickness of the second region 83. The second region 83 preferably may comprise approximately 10-25% of surface area, and in a more preferred embodiment comprises approximately 15% of the rear surface area.

A third region 84 of the first insert 81 has the least thickness and, when coupled to the club head 1, is positioned high on the rear surface, extending towards the top line 12. In the illustrated embodiment, the second region 83 is spaced slightly from the first region 82 by a thin portion of the third region 84. The transitions between the various regions 82, 83, 84 may be stepped or gradual, such as being linearly sloped or curved. The thickness of the third region 84 preferably is from 0.01 to 0.03 inch, and more preferably approximately 0.02 inch. The third region thickness preferably is also approximately half the thickness of the second region 83, meaning within ±0.005 inch or within normal manufacturing tolerances. Alternatively, the thickness of the second region 83 is at least two times that of the third region 84, and may be from two to four times the thickness of the third region 84. The third region 84 preferably may comprise approximately 5-25% of surface area, and in a more preferred embodiment comprises approximately 20% of the rear surface area.

The second insert 85 similarly contains regions corresponding to the various regions of the first insert 81. This second insert 85 is formed of a material that is more rigid than the first insert material, examples including a metallic material such as aluminum or an aluminum alloy. Plastic is another exemplary second insert material. A first region 86 of the second insert 85 corresponds to the first region 82 of the first insert 81. The second insert 85 further contains a third region 88 corresponding to the third region 84 of the first insert 81. Additionally, the second insert 85 includes a second region 87 in the form of windows or apertures that corresponds to the second region 83 of the first insert 81. These windows 87 are openings that pass completely through the second insert 85, allowing the viscoelastic material of the first insert 81 to extend through the second insert 85 to the cavity of the club head 1 (assuming here that a cavity back club head is used). Thus, when assembled in the club head 1, the insert assembly 80 forms both a constrained-layer damper where the second insert 85 overlies the first insert 81 and a free-layer damper where the first insert second region 83 extends through the second insert layer 85. Preferably, the transitions between the various regions 86, 87, 88 match the corresponding transitions of the first insert 81. A thin portion of the second insert 85, preferably within region 88, may span the windows 87 to ensure structural integrity of the second insert 85 is maintained. Preferably, the outer surface of the first insert second region 83 is flush with the outer surface of the second insert third region 88. The outer surface of the second insert 85, such as at regions 86 and 88, may preferably by used for graphics, such as logos designating the club manufacturer and/or model.

The cross-sectional view of FIG. 19 is substantially vertical (that is, in the heel-to-top line direction) and through a central portion of the club head 1, and illustrates the varying thickness of the insert assembly 80. As shown, a ridge 141 may be formed in the lower portion of the rear wall surface adjacent the sole wall, extending rearward therefrom, upon which the rear insert assembly 80 may rest. The inserts 81, 85 may be coupled to the club head 1 in a variety of manners. One such manner includes first coupling the first insert 81 to the rear surface, for example by using an adhesive such as double-sided tape, and then coupling the second insert 85 to the first insert 81 and/or the club head body 10, such as by using an adhesive.

Another manner of connecting the insert assembly 80 to the club head 1 includes first coupling the insert portions 81, 85 together, such as by using an adhesive, and then coupling the assembled insert 80 to the rear surface of the club head 1, such as by using an epoxy. Another preferred way to couple the inserts 81, 85 is by co-molding the viscoelastic material of the first insert 81 to the second insert 85. That is, the second insert 85 may be formed first and then utilized to form at least part of a mold used to create the first insert 81. This allows for extremely tight tolerance control between the inserts 81, 85, helping ensure a desirable solid feel to the resulting golf club.

The top line 12 of the club head 1 illustrated in FIG. 19 defines a notch or groove 121 therein, preferably extending along a majority of the top line 12 from the heel to the toe. The notch 121 of the illustrated example is shown to be in a lower, rear portion of the top line 12. Inclusion of the notch 121 removes relatively heavy material from the uppermost portion of the club head 1, inherently lowering the club head COG. The mass and weight saved through provision of the notch 121 may also be added to more beneficial locations within the club head to, for example, increase the overall size of the club head 1, expand the size of the club head sweet spot, reposition the club head COG, and/or produce a greater MOI measured about either an axis parallel to the Y-axis or Z-axis passing through the COG. This top line notch may be used in conjunction with or as an alternative to the top line insert, discussed and incorporated herein above.

As discussed above, it may be desirable to raise or lower the center of gravity of a club head depending upon the type of club head in a set. For example, a short iron or wedge may have a vertical center of gravity $CG_Z$ that is greater than about 17 mm. Preferably, a short iron or wedge has a vertical center of gravity $CG_Z$ that is greater than about 18 mm. In one embodiment, a short iron or wedge has a vertical center of gravity $CG_Z$ that is greater than about 20 mm. In addition, a long iron may have a vertical center of gravity $CG_Z$ that is less than about 17.5 mm. In one embodiment, the center of gravity $CG_Z$ is less than about 17 mm. In another embodiment, the center of gravity $CG_Z$ is less than about 16.5 mm. Preferably, all of the clubs in a set will have an MOI greater than 2800 $g \cdot cm^2$. Additionally, all of the clubs preferably satisfy equation 1 discussed above.

As also shown in FIG. 19, the club head 1 further includes an insert 90 positioned within a recess in the sole wall, substantially filling this recess that extends toward the sole 13. This insert 90 preferably may be formed of a vibration damping material, and may be a multi-piece insert including, for example, a weight member and/or a manufacturer-identifying medallion. The rear portion of the insert 90 may be dimensioned to overfill the sole wall recess to beneficially ensure there are no gaps between the insert 90 and the club head body 10 after assembly. Such gaps may result from tolerances, and may eventually result in the insert 90 becoming dislodged from the club head 1. The insert 90, as shown, may also abut the lower portion of the rear surface insert 80, further ensuring its fixed retention to the club head 1.

The sole wall insert 90, as well as other medallions and inserts discussed herein, may have multiple components and may be provided in a variety of forms. One such form includes providing a first component formed of a relatively hard material, examples including ABS and polycarbonate (PC), and a second component formed of a relatively soft material, such as polyurethane or another viscoelastic material. The second component provides damping to alleviate unwanted vibration. Providing a relatively hard or rigid material (that is, the first assembly component) within the damping material of the second component may enhance the vibration damping characteristics of the insert assembly. The first component may contain an indicia, such as a manufacturer or model designation. Preferably, the second component is co-molded around the first component, with the first component comprising a portion of the upper surface of the insert/medallion assembly. The components may alternatively be joined together in other manners, such as by interference fit or through the use of an adhesive. The assembled insert may then be subject to a finishing process. One such process is chrome plating, and is appropriate for use with an ABS part. Once the components are assembled, they are submerged into a chrome plating solution such as hexavalent chromium or Cr(VI) compounds, which is then subjected to an electrical current. The current causes electrolytic deposition of chromium onto the ABS part but not the viscoelastic part. Another finishing process is physical vapor deposition, and is appropriate for use with a PC part. Once the components are assembled, an electrical current is imparted to the PC component. The negative voltage applied to the PC part attracts positive ions of the coating material, such as single metal nitrides including TiN, CrN and ZrN, which ions then form a film on the PC part but not the viscoelastic part. In addition to providing an aesthetically pleasing look, these finishing processes also provide the utilitarian benefit of strengthening the first component of the assembly, helping to protect it against damage that it may likely incur through normal use, storage, and transport of the resulting golf club(s). These finishing processes result in a plated plastic assembly. The insert/medallion assembly is then coupled to the club head in known manner.

Figure 20:
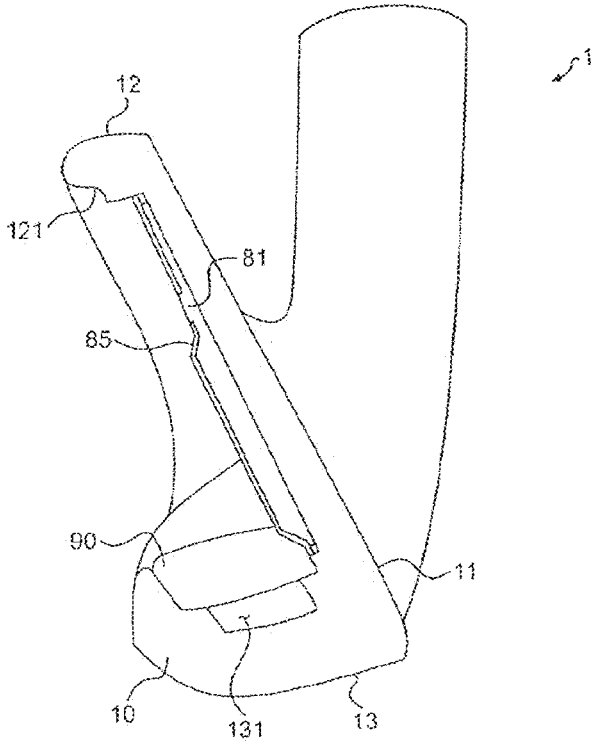
FIG. 20 shows a cross-sectional view of a golf club head of the present invention.

FIG. 20 shows a cross-sectional view of a golf club head 1 of the present invention. This club head is substantially similar to the illustrated club head of FIG. 19, but further includes a secondary recess 131 underneath the sole wall insert 90. This secondary recess 131 extends toward the sole 13 from the primary sole wall recess, in which the insert 90 is retained. Positioned in a central region of the club head 1 between the heel and toe, the secondary recess 131 removes additional mass and weight from the central portion of the club head and inherently biases mass and weight toward the perimeter of the club head 1. This secondary recess 131, which may be relatively small compared to the primary sole wall recess, may also beneficially allow the club head designer or manufacturer to discretely add weight to bring the club swingweight to a desired level. Such weight may be included in a variety of manners, such as a metallic weight member or simply just an adhesive, and may completely or partially fill the recess 131.

FIGS. 21-34 illustrate various embodiments of a multi-functional damping assembly consistent with the present disclosure. As will be described in greater detail herein, damping assemblies of the present invention are configured to provide dampening of vibrational response of the club head upon impact of the club face (also referred to herein as "ball striking face") with a golf ball, thereby improving the feel of the club. Additionally, damping assemblies of the present invention are also configured to provide information to a golfer in the form of visual and/or audible feedback indicative of one or more characteristics of a golf ball strike with the club face. More specifically, the visual feedback and/or audible feedback may correlate to one or more characteristics of the golf ball strike, such as impact intensity, gradient of impact intensity along the club face, and/or location of impact on the club face, thereby providing a golfer with shot-specific data that can be useful in improving a golfer's game.

Accordingly, a damping assembly consistent with the present invention serves as a multifunctional element, configured to provide effective vibration damping to improve the feel of the club and further configured to provide a golfer with visual and/or audible indication as to timing, location, and amount of vibration damping occurring on the club face, thereby allowing the golfer to better understand how the club head functions and the quality of their golf ball strike, which is particularly beneficial in improving the golfer's game.

It should be noted that the damping assemblies described herein, particularly with reference to FIGS. 21-34, may be embodied as any one of the previously described elements for providing vibrational damping (e.g., second body portion 22, damping member 40, medallion 70, insert 80, insert 90, etc.) and may be included within any one of the golf club head embodiments previously described and shown in FIGS. 1-20.

Referring to the FIGS. 21-34 and following description, golf clubs and golf club heads in accordance with the present invention are described. The golf club and club head structures described herein may be described in terms of an iron-type golf club. However, the present invention is not limited to the precise embodiments disclosed herein but applies to golf clubs generally, including hybrid clubs, wood-type golf clubs, utility-type golf clubs, and the like.

Figure 21:
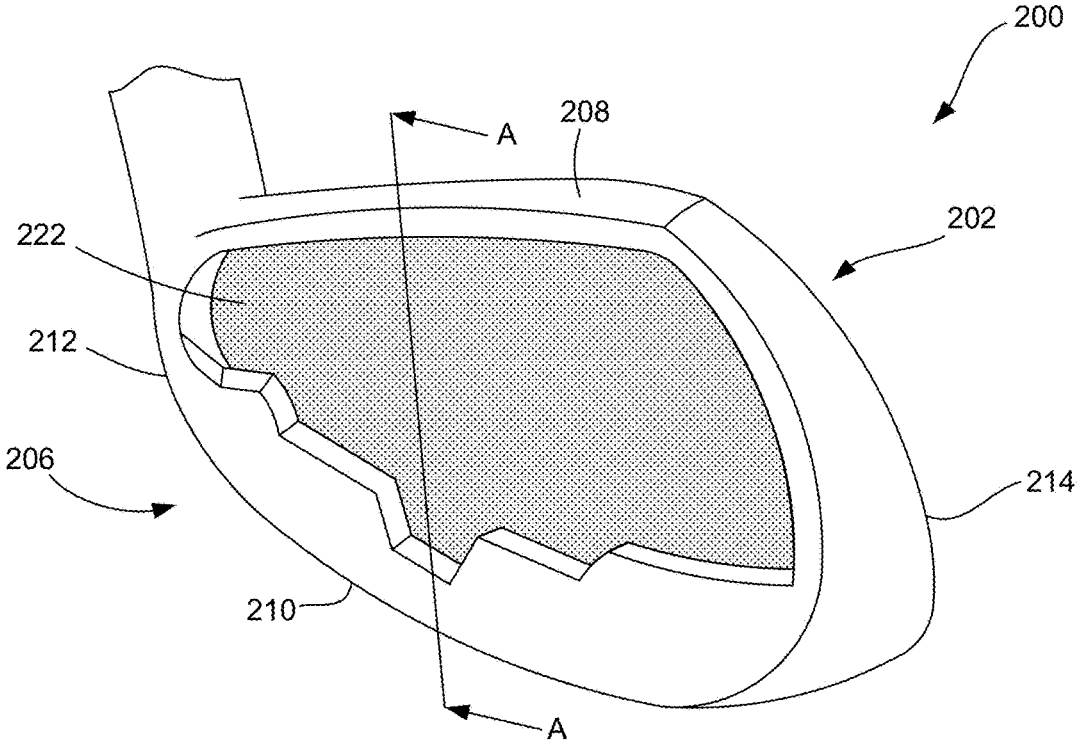
FIG. 21 is a rear perspective view of a golf club head including an exemplary embodiment of a damping assembly consistent with the present disclosure.
Figure 22:
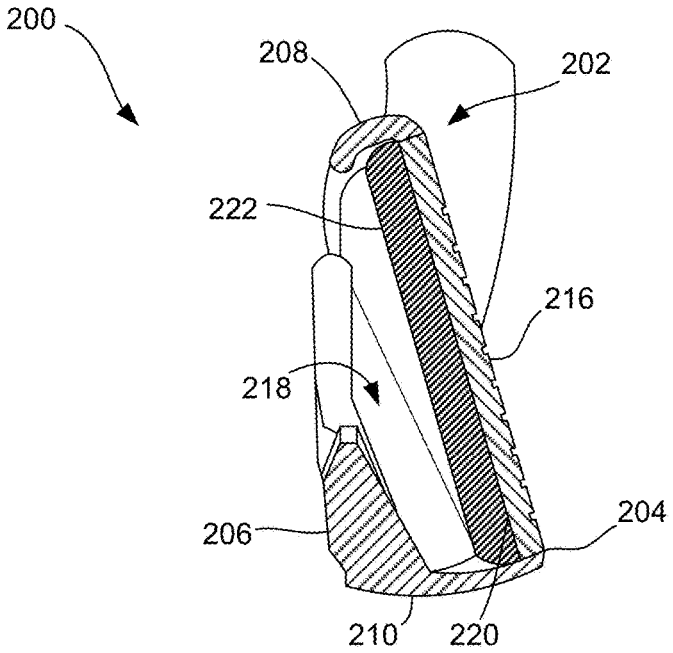
FIG. 22 is a cross-sectional view of the golf club head of FIG. 21 taken along lines A-A.

FIG. 21 is a rear perspective view of an iron-type golf club head 200 including an exemplary embodiment of a damping assembly 222 consistent with the present disclosure. FIG. 22 is a cross-sectional view of the golf club head 200 taken along lines A-A. As shown, the golf club head 200 includes a golf club body 202 having a front portion 204, a rear portion 206, a topline 208, a sole 210, a heel 212, and a toe 214. The club head 200 further includes a ball striking face 216 disposed on the front portion 204 of the club head body 202. As shown more clearly in FIG. 22, a rear cavity 218 is generally defined between the ball striking face 216 and the rear portion 206 of the club head body 202.

The club head further includes a damping assembly 222 positioned adjacent to a rear surface 220 of the ball striking face 216. In some embodiments, at least a portion of the damping assembly 222 may be disposed within the rear cavity 218 and may further be in contact with a rear portion 206 of the body 202. In the illustrated embodiment, the damping assembly 222 generally covers most of the rear surface 220 of the ball striking face 216. It should be noted that, in some embodiments, the damping assembly 222 may only cover specific portions of the rear surface 220 of the ball striking face 216 (e.g., portion near the heel 212, portion near the toe 214, portion near center between heel 212 and toe 214, etc.). Furthermore, in other embodiments, the club head 200 may include a plurality of discrete damping assemblies positioned along different portions of the rear surface 220 of the ball striking face 216.

It should be noted that embodiments of the damping assembly described herein is not limited to use with iron-type clubs only. Accordingly, a damping assembly consistent with the present disclosure may be included in other club head embodiments, such as in a "wood-type" golf clubs and hollow golf club heads, e.g., clubs and club heads typically used for drivers and fairway woods. For example, in some embodiments, a damping assembly described herein may be included within an interior cavity of a wood-type club head and be placed in contact with a rear surface of the club face. Furthermore, the wood-type club head may have an accessible interior, thereby allowing a golfer access into the hollow cavity of the club head for placement or removal of one or more components within, such as the damping assembly. Embodiments of wood-type club heads with accessible interior are discussed in GOLF CLUB HEAD WITH ACCESSIBLE INTERIOR, U.S. patent application Ser. No. 14/455,483 to Tim Beno et al, filed on Aug. 8, 2014, GOLF CLUB HEAD WITH ACCESSIBLE INTERIOR, U.S. Pub. 2014/0228142 to Tim Beno et al., and GOLF CLUB HEAD WITH REMOVABLE COMPONENT, U.S. Pub. 2014/0187346 to Tim Beno et al., the contents of each of which are incorporated herein by reference in their entirety.

Figure 23:
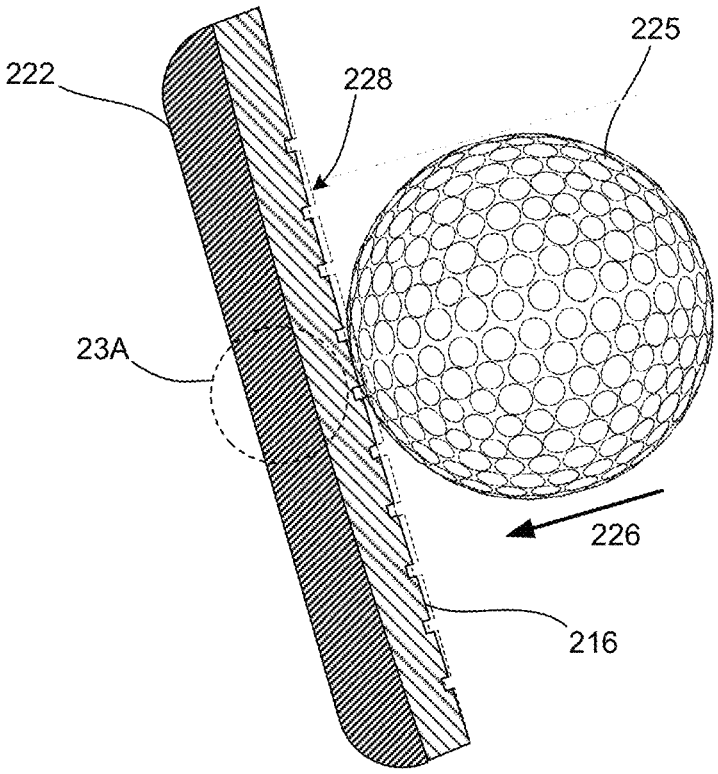
FIG. 23 is an enlarged cross-sectional view of the damping assembly and ball striking face illustrating impact between the ball striking face and a golf ball.

FIG. 23 is an enlarged cross-sectional view of the damping assembly 222 and ball striking face 216 illustrating impact between the ball striking face 216 and a golf ball 225. As shown, during a golf ball impact, a sizable force is applied to the face 216 as the golf ball 225 makes contact with the face 216, as indicated by arrow 226. In response, the face 216 may be configured to deflect a relatively small amount (e.g., 0.5 mm), as indicated by arrow 228.

The damping assembly 222 is configured to dampen vibrations in the club head 200 upon impact between the ball striking face 216 and golf ball 225. In particular, the damping assembly 222 includes a damping material 224, at least a portion of which is in contact with the rear surface 220 of the ball striking face 216 and configured to receive and dissipate a deflection force imparted thereon from the ball striking face 216 caused by the impact between the ball striking face 216 and the golf ball 225.

Figure 23A:
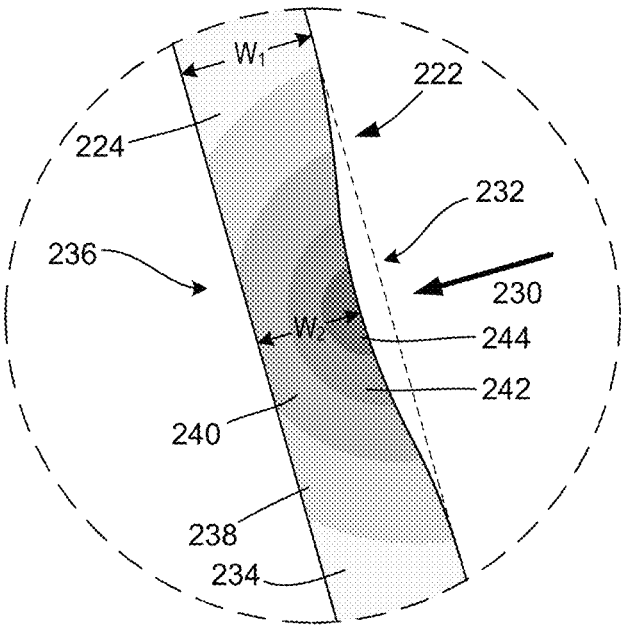
FIG. 23A is an enlarged cross-sectional view of the damping assembly of FIG. 23, a portion of which is configured to provide a visual indication of one or more characteristics of a force imparted thereon based on the impact between the ball striking face and a golf ball.

FIG. 23A is an enlarged cross-sectional view of the damping assembly 222 illustrating response of the damping material 224 to receipt of the deflection force imparted thereon as a result of the impact between the ball striking face 216 and the golf ball 225. As shown, a portion of the damping assembly 222 may be configured to dissipate the deflection force 230 by way of compression, as indicated by arrow 232. In particular, the damping material 224 may include an elastic material configured to transition between a normal, uncompressed state and one or more varying degrees of compression so as to accommodate the impact force and dissipate and vibrational response so as to improve the feel of the club upon golf ball impact.

For example, when in a normal, uncompressed state, the damping assembly 222 may have a first width $W_1$. Upon receipt of the impact force 230, a portion of the damping assembly 222 may compress, as indicated by arrow 232, and have a second width $W_2$ that is less than the first width $W_1$. As generally understood, the damping assembly 222 may be configured to compress to a variety of different widths depending on the amount of force or load imparted thereon. The damping material 224 may include a variety of durable and elastic materials capable of undergoing repeated impacts, the material including, but not limited to, a bulk molding compound, rubber, urethane, polyurethane, a viscoelastic material, a thermoplastic or thermoset polymer, butadiene, polybutadiene, silicone, and a combination of at least two thereof.

The damping material 224 may further be configured to provide a visual indication of one or more characteristics of impact between the ball striking face 216 and the golf ball 225 based on the force imparted thereon. In particular, the damping material 224 may be configured to change appearance in response to the deflection force 230. As shown, the damping material 224 may be configured to transition between one of a plurality of different colors and/or shades or tones of color based on the amount of compression associated with the impact force. For example, the damping material 224 may include a chromogenic polymer configured to adjust appearance in response to particular stimuli, including, but not limited to, temperature, voltage, pressure, and/or light. In the illustrated embodiment, the damping material 224 may include a chromogenic polymer configured to adjust in appearance in response to pressure (e.g., change appearance based on compression as a result of the impact force). These types of polymers may be referred to as piezochromic. The damping material 224 may include any type of polymer material having chromogenic properties, specifically configured to change color or other optical properties in response to pressure applied thereto.

Discussion and specific examples of chromogenic polymers, and chromogenic materials in general, is found in publication "Piezochromic Polymer Materials Displaying Pressure Changes in Bar-Ranges", A. Seeboth, D. Loetzsch, R. Ruhmann, American Journal of Materials Science 2011, 1(2), p. 139-142, DOI: 10.5923/j.materials.20110102.23, and research/development related to chromogenic materials is offered by Fraunhofer Institute for Applied Polymer Research (IAP) (Germany), indicated by brochure titled "Chromogenic Polymers", http://www.iap.fraunhofer.de/content/dam/iap/en/documents/FB2/Chromogenic-Polymers_Seeboth_2012_web.pdf, the contents of each of which are incorporated herein by reference in their entirety.

As shown, the appearance of the damping material 224 may adjust based on a stimulus pressure. For example, the default (base) appearance of the damping material (e.g., under little or no compression) is shown as 234. Upon compression of a portion of the damping material 224, said portion of the damping material 224 may be configured to provide a color gradient 236 indicative of one or more characteristics of the impact between the ball striking face 216 and the golf ball 225. The one or more characteristics of the impact between the ball striking face and the golf ball may include, but are not limited to, magnitude of the impact, distribution of the impact on the ball striking face 216, location of the impact on the ball striking face 216, and a combination of at least two thereof.

In the illustrated embodiment, the color gradient 236 includes one or more colors/tones/shades indicative of magnitude of impact force or load upon the damping assembly 222. Depending on the force of impact, and thus the amount of compression, for example, the color gradient 236 may include one or more different colors/shades/tones, wherein each color/shade/tone are indicative of a corresponding magnitude of impact. As shown in FIG. 23A, the color gradient 236 consists of at least four different colors (238-244), each of which corresponds to a different magnitude of impact. As generally understood, the magnitude of impact may generally dissipate from an initial contact point (or greatest amount of compression). For example, the colors of the gradient 236 may transition from a darker appearance to a lighter appearance when moving from the area of greatest compression (e.g., at portion having second width $W_2$) to the area of least compression (e.g., at portion having first width $W_1$). As such, the first color 238 may be lighter than the second color 240, which may be lighter than the third color 242, which may be lighter than the fourth color 244. Each of the colors 238-244 is indicative of a corresponding magnitude of impact, wherein color 238 indicates a first magnitude of force, which is less than a second magnitude of force indicated by color 240, which is less than a third magnitude of force indicated by color 242, which is less than a fourth magnitude of force indicated by color 244. Accordingly, the greater amount of force imparted upon the damping assembly 222 results in a greater amount of compression, thereby resulting in a more contrasting color/shade/tone so as to indicate the magnitude of force.

Figure 24:
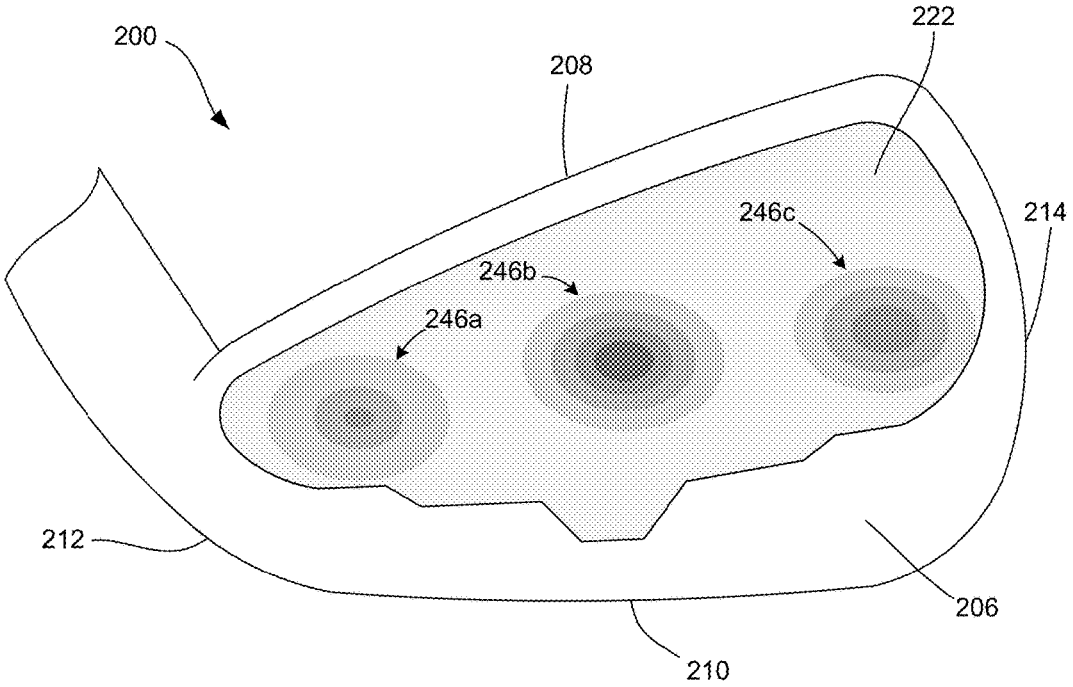
FIG. 24 is a rear view of the golf club head showing individual visual color gradients along different portions of the damping assembly.

FIG. 24 is a rear view of the golf club head 200 showing individual visual color gradients 236*a*-236*c* along different portions of the damping assembly 222. As shown, the damping material 224 may be configured to adjust in appearance upon a golf ball strike, thereby providing a visual color gradient indicative of one or more characteristics of any given golf ball strike. In the illustrated embodiment, at least three different color gradients 236*a*-236*c* are shown for illustrative purposes. It should be noted that the damping material 224 is configured to adjust in visual appearance for a predetermined amount of time (e.g., 1 to 10 seconds) so as to allow the golfer sufficient time to view the rear of the club head and the change in appearance. Accordingly, after such predetermined time, and after removal of the impact force upon the damping assembly 222, the damping material 224 is configured to return to the default, base color. As such, in one embodiment, only one color gradient is provided at any given moment, due in part to the predetermined time in which the damping material 224 returns to normal state. For example, the damping material 224 is configured to return to normal state (base color 234) between consecutive shots, so as to prevent any confusion as to which color gradient corresponds to any given shot.

Figure 25:
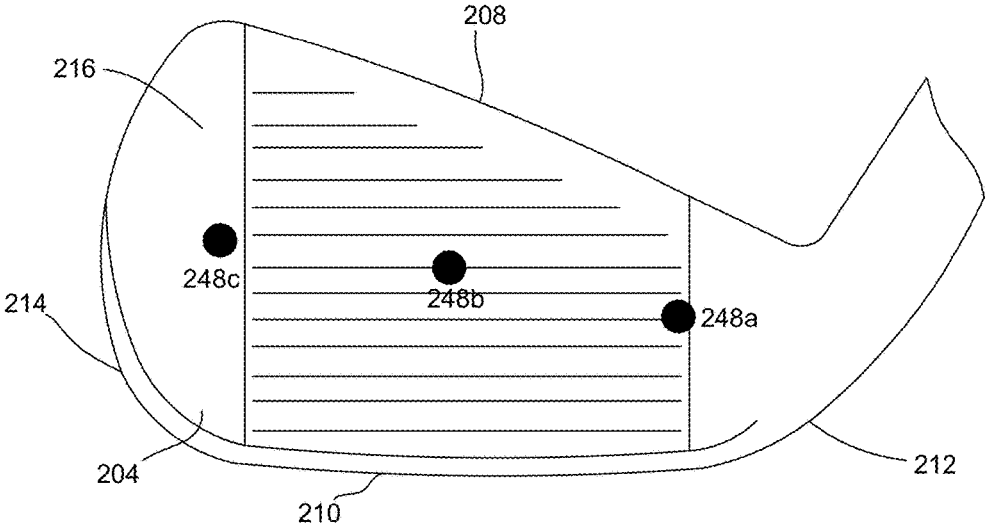
FIG. 25 is front view of the golf club head showing the locations of the ball strikes on the ball striking face that correspond to the individual visual color gradients provided by the damping assembly shown in FIG. 24.

As shown in FIG. 24, the damping assembly 222 generally covers most of the rear surface 220 of the ball striking face 216. Accordingly, the damping material 224 is configured to provide a plurality of visual color gradients on most of, if not the entire, surface of the damping assembly 222 based on the location of the face 216 which made contact with the golf ball 225 during any given shot. The color gradients may provide one or more characteristics of the impact between the ball striking face 216 and the golf ball 225, including, but not limited to, magnitude of the impact, distribution of the impact on the ball striking face 216, location of the impact on the ball striking face 216, and a combination of at least two thereof. For example, as shown in FIG. 25, color gradient 246*a* is indicative of a golf ball strike on the face 216 near the heel 212, as indicated by 248*a*, while color gradient 246*c* is indicative of a golf ball strike on the face 216 near the toe 214, as indicated by 248*c*. Color gradient 246*b* is indicative of a golf ball strike ion the ball striking face 216 near the center of the face 216, indicated by 248*b*.

Accordingly, in addition to providing a golfer with visual indication of active compression of the damping assembly and confirming that the vibrational damping is occurring, the damping assembly 222 further provides a visual feedback indicating the location of their shot on the club face. Providing a visual indication of shot location can be particularly useful and either confirming to the golfer that their shot was as intended or further aid the golfer in correcting their swing so as to improve their next shot. Also, as shown, the color gradients 246*a*-246*c* can have different impact distribution patterns depending on the magnitude of impact. For example, color gradient 246*b* appears to have a darker appearance, thus providing visual indication to the golfer that their shot had greater impact force than the shot corresponding to gradients 246*a* or 246*c*. Providing additional shot data, such as the magnitude of impact, may further aid the golfer in improving their game. Accordingly, the damping assembly 222 is configured to provide a golfer with visual feedback so as to provide information confirming not only the occurrence of vibrational damping, but to further provide information related to the quality of any given golf ball strike, which is particularly beneficial in improving the golfer's game.

Figure 26:
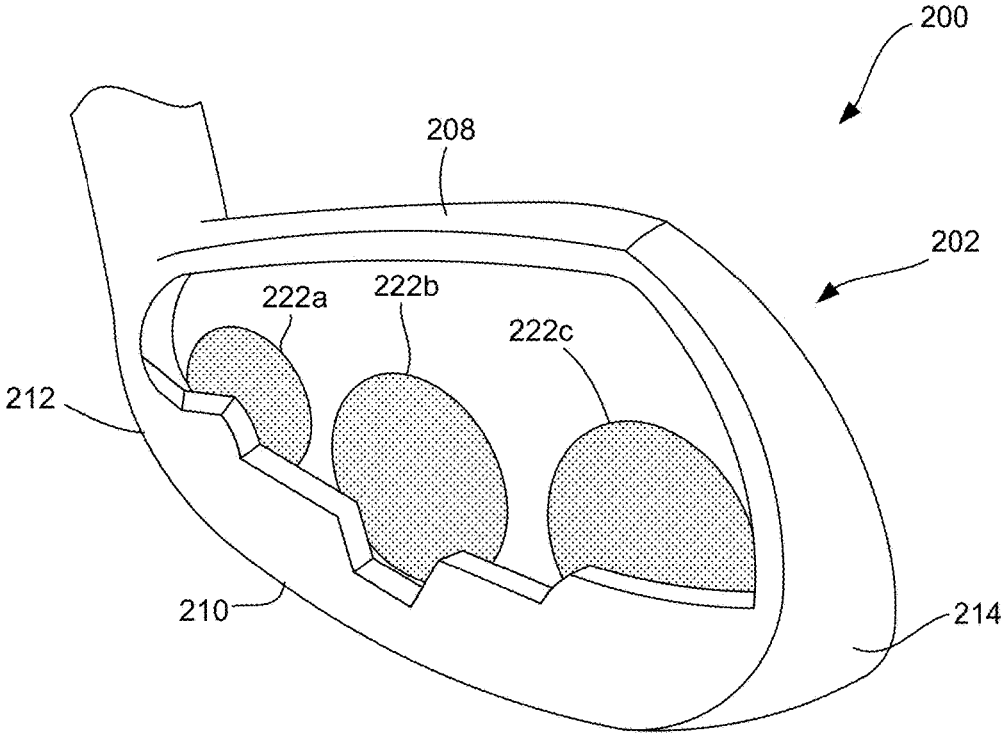
FIG. 26 is perspective rear view of a golf club head including a plurality of discrete damping assemblies positioned along the rear surface of the ball striking face.

FIG. 26 is perspective rear view of a golf club head 200 including a plurality of individual damping assemblies 222*a*-222*b* positioned along the rear surface 220 of the ball striking face 216. Rather than a single damping assembly covering most, if not all, of the rear surface 220 of the ball striking face 216, as shown in FIG. 21, golf club heads of the present invention may include a plurality of individual damping assemblies spaced along the rear surface 220 of the ball striking face 216. As shown, at least three individual damping assemblies are provided on different portions, a first assembly 222*a* positioned adjacent to the heel 212, a second assembly 222*b* positioned centrally, and a third assembly 222*c* positioned adjacent to the toe 214. Accordingly, depending on the golf ball strike on the face 216, a corresponding assembly 222 will adjust in appearance.

Figure 27:
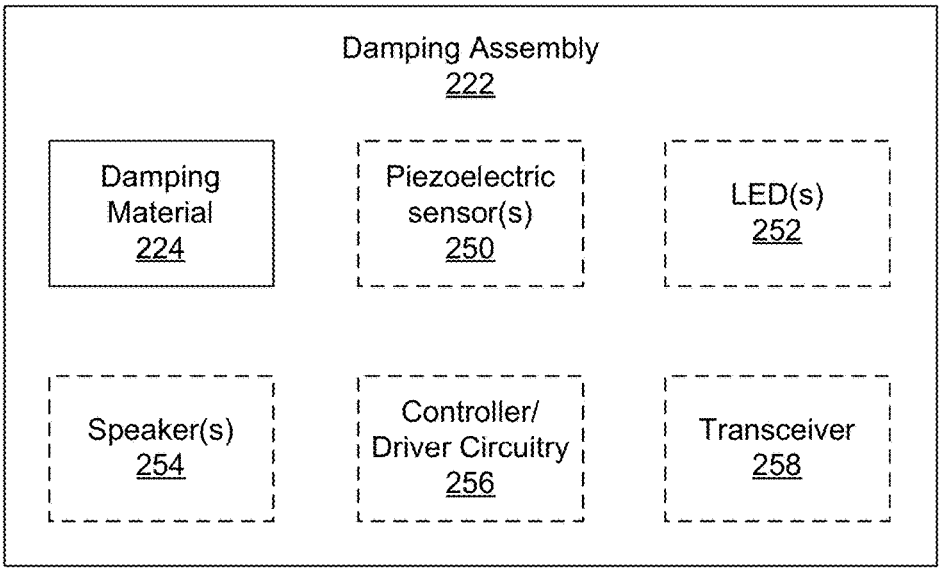
FIG. 27 is a block diagram illustrating one embodiment of a damping assembly consistent with the present disclosure.
Figure 28:
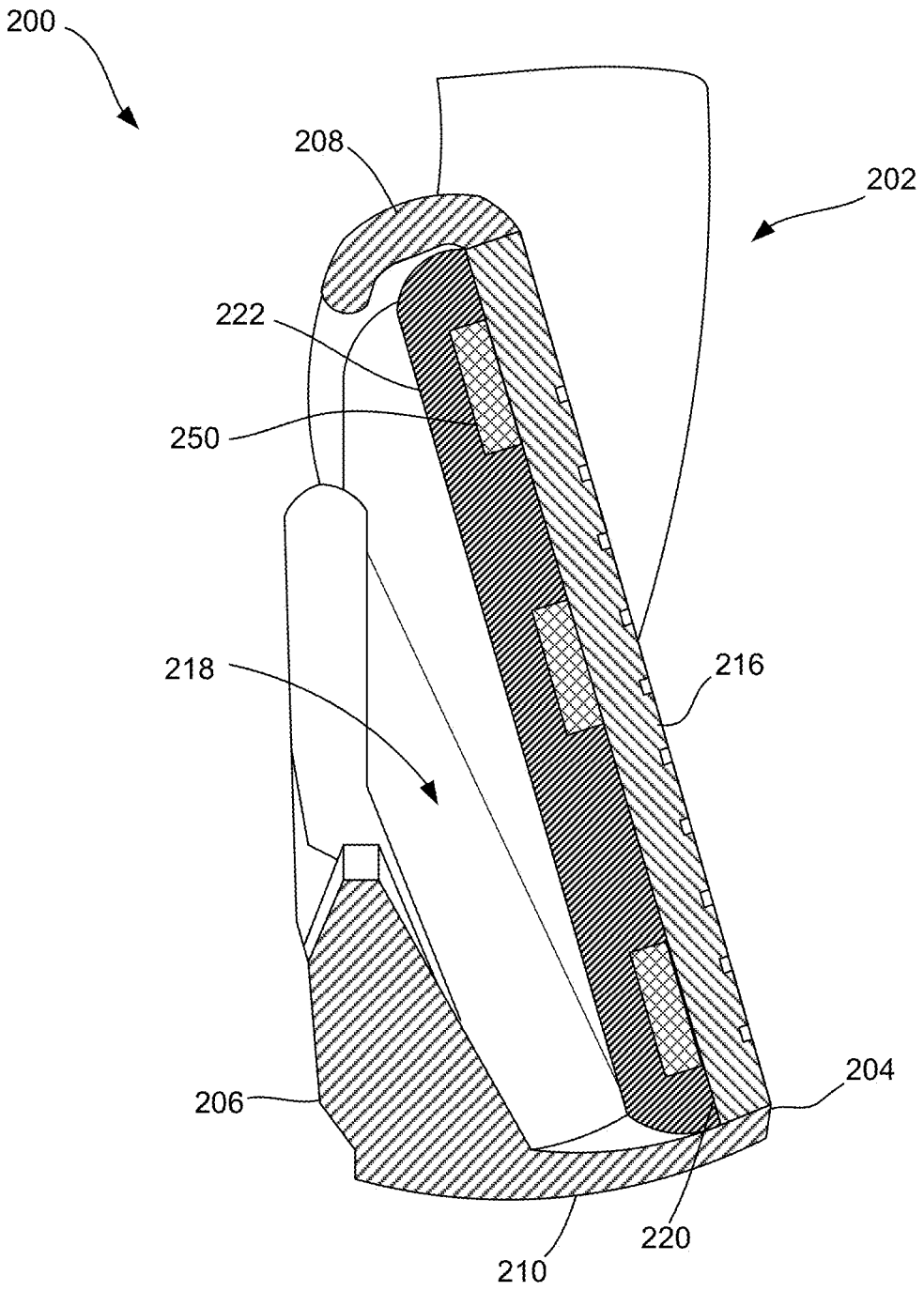
FIG. 28 is a cross-sectional view of a golf club head including another embodiment damping assembly having one or more piezoelectric sensors.

FIG. 27 is a block diagram illustrating one embodiment of a damping assembly 222 consistent with the present disclosure. As shown, the damping assembly 222 may include additional elements, in addition to damping material 224. For example, the damping assembly 222 may include one or more piezoelectric sensors 250, one or more light-emitting devices (e.g., light emitting diodes) 252, one or more sound-emitting devices (e.g., speakers) 254, a controller/driver circuitry 256, and/or a transceiver 258.

In each of the following damping assembly embodiments described herein, particularly with reference to FIGS. 28-34, the damping material 224 is configured to dampen vibrations in the club head 200 upon impact between the ball striking face 216 and a golf ball 225. Accordingly, at least a portion of the damping material 224 is in contact with the rear surface 220 of the ball striking face 216 and configured to receive and dissipate a deflection force imparted thereon from the ball striking face 216 caused by the impact between the ball striking face 216 and the golf ball 225. The damping material 224 may include a variety of durable and elastic materials capable of undergoing repeated impacts, the material including, but not limited to, a bulk molding compound, rubber, urethane, polyurethane, a viscoelastic material, a thermoplastic or thermoset polymer, butadiene, polybutadiene, silicone, and a combination of at least two thereof.

Furthermore, in each of the following damping assembly embodiments described herein (with reference to FIGS. 28-34), the damping assembly 222 includes one or more piezoelectric sensors 250, each of the piezoelectric sensors 250 is in contact with the rear surface 220 of the ball striking face 216 and configured to generate at least one electrical signal in response to receipt of an impact force imparted thereon as a result of impact between the face 216 and the golf ball 225. As generally understood, the piezoelectric sensor 250 may include a device that uses the piezoelectric effect to measure changes in pressure, acceleration, strain, and/or force by converting them to an electrical charge.

Figure 29:
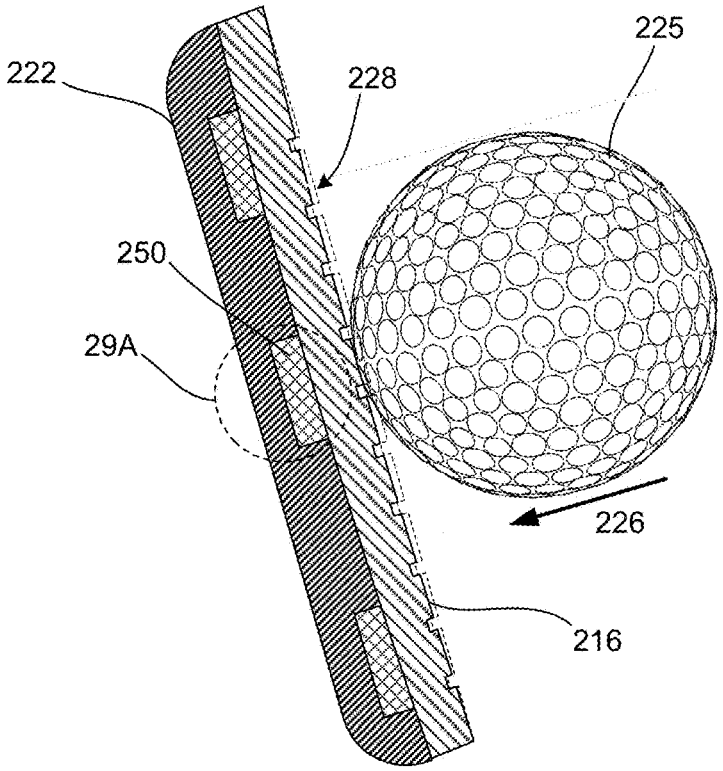
FIG. 29 is an enlarged cross-sectional view of the damping assembly and ball striking face of the club head of FIG. 28 illustrating impact between the ball striking face and a golf ball.

In particular, as shown in FIG. 29, during a golf ball impact, a sizable force is applied to the face 216 as the golf ball 225 makes contact with the face 216, as indicated by arrow 226. In response, the face 216 may be configured to deflect a relatively small amount (e.g., 0.5 mm), as indicated by arrow 228. The one or more piezoelectric sensors 250 are configured to receive the deflection force from the face 216 and further generate an electrical signal or charge corresponding to the deflection force, and thus corresponding to the impact between the face 216 and golf ball 225. As described in greater detail herein, the electrical signal may then be used to provide visual feedback and/or an audible feedback to a golfer indicative of one or more characteristics of the impact between the ball striking face 216 and the golf ball 225. For example, in one embodiment, the electrical signal may be transmitted to a chromogenic damping material 224 configured to adjust in appearance in response to predetermined voltage of the electrical signal. In another embodiment, the electrical signal may be transmitted to a light emitting diode (LED) configured to emit light in response to the electrical signal. In another embodiment, the electrical signal may be transmitted to a speaker configured to emit an audible alert in response to the electrical signal. Still, yet in another embodiment, the electrical signal may be communicated and shared with an external computing device and/or internet-based service so as to provide data related to the impact between the ball striking face 216 and the golf ball 225, thereby providing shot data for subsequent visual display to the golfer.

Figure 29A:
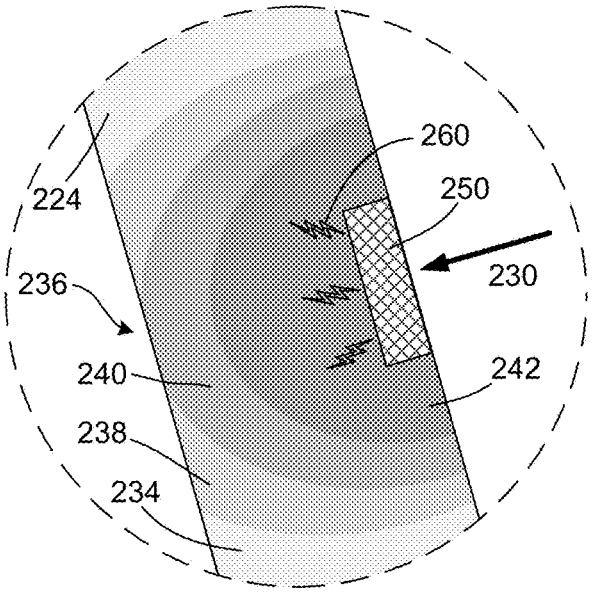
FIG. 29A is an enlarged cross-sectional view of the damping assembly of FIG. 28, a portion if which is configured to provide a visual indication of one or more characteristics of a force imparted on at least a piezoelectric sensor based on the impact between the ball striking face and a golf ball.

FIG. 29A is an enlarged cross-sectional view of the damping assembly 222 illustrating response of at least one piezoelectric sensor 250 to receipt of the deflection force imparted thereon as a result of the impact between the ball striking face 216 and the golf ball 225. As shown, the piezoelectric sensor 250 is configured to generate an electrical signal 260 in response to receipt of the deflection force 230 from the face 216. The electrical signal generally corresponds to the deflection force 230 imparted thereon, and thus corresponds to the impact between the face 216 and golf ball 225. For example, the piezoelectric sensor 250 may be configured to generate one of a plurality of electrical signals in response to receipt of one of a plurality of predetermined forces imparted thereon. Each of the plurality of electrical signals correlates to at least a magnitude of force of impact between the ball striking face and the golf ball.

In other words, the piezoelectric sensor 250 is configured to generate a first electrical signal in response to a first golf ball strike, such that the first electrical signal may include a particular voltage indicative the magnitude of impact of the first golf ball strike. The piezoelectric sensor 250 is further configured to generate a second electrical signal in response to a second golf ball strike, wherein the second electrical signal includes a particular voltage indicative of the magnitude of impact of the second golf ball strike. For example, the piezoelectric sensor 250 may be configured to generate a higher voltage signal in response to a golf ball strike having a greater magnitude of force and generate a lower voltage signal in response to a golf ball strike having a lower magnitude of force.

As shown in FIG. 29A, the damping material 224 may include a chromogenic polymer, as previously described herein. However, instead of changing appearance in response to a pressure stimulus applied thereto, the chromogenic damping material shown in FIG. 29A may be configured to change appearance in response to one or more electrical signals generated and applied by the one or more piezoelectric sensors 250. Similar to the embodiment illustrated in FIG. 23A, the chromogenic damping material 224 may be configured to transition between one of a plurality of different colors and/or shades or tones of color based on the electric signal applied thereto.

For example, the appearance of the damping material 224 may adjust based on a stimulus voltage. As shown, the default (base) appearance of the damping material (e.g., under little or no voltage) is shown as 234. Upon application of the electrical signal 260 generated by the piezoelectric sensor 250 (in response to the deflection force 230), a portion of the damping material 224 may be configured to provide a color gradient 236 indicative of one or more characteristics of the impact between the ball striking face 216 and the golf ball 225. The one or more characteristics of the impact between the ball striking face and the golf ball may include, but are not limited to, magnitude of the impact, distribution of the impact on the ball striking face 216, location of the impact on the ball striking face 216, and a combination of at least two thereof.

In the illustrated embodiment, the color gradient 236 includes one or more colors/tones/shades indicative of magnitude of impact force or load upon the piezoelectric sensor 250, thus indicative of the impact between the face 216 and golf ball 225. Depending on the force of impact (and the resulting voltage generated by the piezoelectric sensor 250), the color gradient 236 may include one or more different colors/shades/tones, wherein each color/shade/tone are indicative of a corresponding magnitude of impact. As shown in FIG. 29A, the color gradient 236 consists of three different colors (238-242), each of which corresponds to a different magnitude of impact. In one embodiment, a higher voltage may correspond to a higher magnitude of impact imparted on the piezoelectric sensor 250, and application of a higher voltage to the damping material 224 may result in a color/shade/tone having greater contrast relative to the base appearance 234 (e.g., color 242). Similarly, a lower voltage may correspond to a lower magnitude of impact imparted on the piezoelectric sensor 250, and application of a lower voltage to the damping material 224 may result in a color/shade/tone having lower contrast relative to the base appearance 234 (e.g., color 238).

In one embodiment, the chromogenic damping material 224 may include an electro-active polymer configured to adjust in appearance in response to application of a voltage thereto. Upon removal of the voltage, the electro-active polymer is configured to return to the base appearance. Discussion and examples of chromogenic polymers, particularly electro-active polymer, is found in publication "Electroactive Non-Ionic Poly(vinyl alcohol) Gel Actuator" S. Popovic, C. Xu, H. Tamagawa, and M. Taya, Proc.SPIE-The International Society for Optical Engineering, 4329, pp. 238-255, 2001, the content of which is incorporated herein by reference in its entirety.

Depending on the placement of the piezoelectric sensors 250 and the overall coverage of the rear surface 220 of the ball striking face 216, the damping assembly may be similar to the damping assembly shown and described with reference to FIG. 24. For example, a plurality of piezoelectric sensors 250 may be placed along most, if not all, of the rear surface 220 of the ball striking face 216, such that the damping assembly is configured to adjust in appearance in response to a golf ball strike on most, if not all, locations on the face 216. In other embodiments, discrete damping assemblies having a piezoelectric sensor 250 and chromogenic material may be placed on specific portions of the rear surface 220 (e.g., near heel 212, near toe 214, center portion between heel and toe, etc.) and adjust in appearance in response to golf ball strikes on such specific portions.

Figure 30:
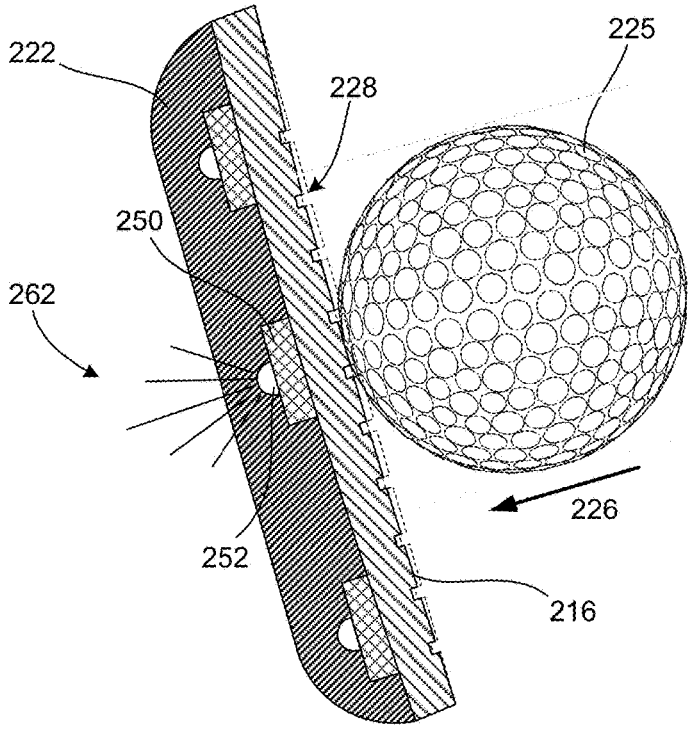
FIG. 30 is a cross-sectional view of a golf club head including another embodiment of a damping assembly having one or more piezoelectric sensors and one or more light sources (e.g., LEDs) configured to emit light to provide visual indication of one or more characteristics of a force imparted on at least a piezoelectric sensor based on the impact between the ball striking face and a golf ball.

FIG. 30 is a cross-sectional view of a golf club head 200 in which the damping assembly 222 includes one or more piezoelectric sensors 250 and one or more light sources 252 in electrical communication with the piezoelectric sensors 250. The one or more light sources 252 are configured to emit light 262 in response to application of an electrical signal thereto from one or more piezoelectric sensors 250. The emitted light provides visual indication of one or more characteristics of a force imparted on at least one of the piezoelectric sensors 250 based on the impact between the ball striking face 216 and a golf ball 225. In one embodiment, the lights sources 252 may include, for example, light emitting diodes (LEDs).

As previously described, the piezoelectric sensor 250 is configured to generate an electrical signal 260 (see FIG. 29A) in response to receipt of the deflection force 230 from the face 216. The electrical signal generally corresponds to the deflection force 230 imparted thereon, and thus corresponds to the impact between the face 216 and golf ball 225. For example, the piezoelectric sensor 250 may be configured to generate one of a plurality of electrical signals in response to receipt of one of a plurality of predetermined forces imparted thereon. Each of the plurality of electrical signals correlates to at least a magnitude of force of impact between the ball striking face and the golf ball.

Accordingly, the piezoelectric sensor 250 is configured to generate a first electrical signal in response to a first golf ball strike, such that the first electrical signal may include a particular voltage indicative the magnitude of impact of the first golf ball strike. The piezoelectric sensor 250 is further configured to generate a second electrical signal in response to a second golf ball strike, wherein the second electrical signal includes a particular voltage indicative of the magnitude of impact of the second golf ball strike. For example, the piezoelectric sensor 250 may be configured to generate a higher voltage signal in response to a golf ball strike having a greater magnitude of force and generate a lower voltage signal in response to a golf ball strike having a lower magnitude of force.

In the illustrated embodiment, the damping assembly 222 may generally include a damping material 224 configured to only provide vibrational damping (e.g., does not contain a chromogenic material). It should be noted that in other embodiments, the damping material may optionally include chromogenic polymer and thus may adjust in appearance in response to either compression and/or an electrical signal, as previously described.

As shown, the one or more piezoelectric sensors 250 and LEDs 252 may be embedded within the damping material 224, such that they are not readily visible from an exterior view of the club head. In some embodiments, the damping material 224 may include a relatively transparent or translucent material, for example, so as to allow light to pass through. Additionally, or alternatively, the damping material 224 may provide optical effects. For example, one or more portions of the damping material 224 may have a shape/contour and/or be composed from a material having an optical spectral effect, such as a guiding effect so as to direct the light towards a desired direction. For example, in one embodiment, one or more portions of the damping assembly 222 may be configured to carry light towards the rear 206 of the club head 200. Accordingly, in some embodiments, the damping assembly 222 material may additionally, or alternatively, having a scattering effect on light.

As shown, in some embodiments, a single LED or a set of LEDs 252 may be in alignment and/or associated with a single piezoelectric sensor 250, such that upon generation of an electrical signal and subsequent activation of the LED 252 or set of LEDS 252, light is emitted from a location on the rear surface 220 of the face 216 associated with placement of the piezoelectric sensor 250, thereby indicating the location of the ball striking face 216 upon which the golf ball was struck.

The LEDs 252 may be configured to emit light indicative of one or more characteristics of the impact between the ball striking face 216 and the golf ball 225, including, but not limited to, magnitude of the impact, distribution of the impact on the ball striking face 216, location of the impact on the ball striking face 216, and a combination of at least two thereof. For example, in one embodiment, the LEDs 252 may be configured to emit different intensities of light and/or different colors indicative of corresponding magnitudes of impact between the club face 216 and golf ball 225. In this example, each LED 252 may have an integrated driver circuitry or may be coupled to the controller/driver circuitry 256 (shown in FIG. 27) configured to control the light emission of the LED 252. In particular, the controller/driver circuitry 256 may be configured to receive an electrical signal generated by a piezoelectric sensor 250 and further control light emission of any given LED 252 based on the electrical signal.

For example, upon receipt of a first electrical signal (having a first voltage) from a piezoelectric sensor, the controller/driver circuitry 256 may be configured to control the LED 252 to emit a first light pattern (e.g., intensity, color, emission length, etc.) corresponding the first electrical signal. In this instance, the first electrical signal may be generated based on a golf ball strike having a relatively high impact force (e.g., high impact golf ball strike). Accordingly, the LED 252 may be controlled to emit a really intense light and/or a light of a specific color (e.g. red), thereby indicating to a golfer that the shot was of high impact. Upon receipt of a second electrical signal (having a second voltage) from the piezoelectric sensor 250, the controller/driver circuitry 256 may be configured to control the LED 252 to emit a second light pattern (e.g., intensity, color, emission length, etc.) corresponding the second electrical signal. In this instance, the second electrical signal may be generated based on a golf ball strike having a low or medium impact force. In turn, the LED 252 may be controlled to emit a less intense light and/or a light of a specific color (e.g. yellow), thereby indicating to a golfer that the shot was of low or medium impact. The LEDs 252 may only emit light for a predetermined period of time so as to allow a golfer to view the generated light. Upon withdrawal of the electrical signal, the LEDs 252 will shut off until the next golf ball strike.

Figure 31:
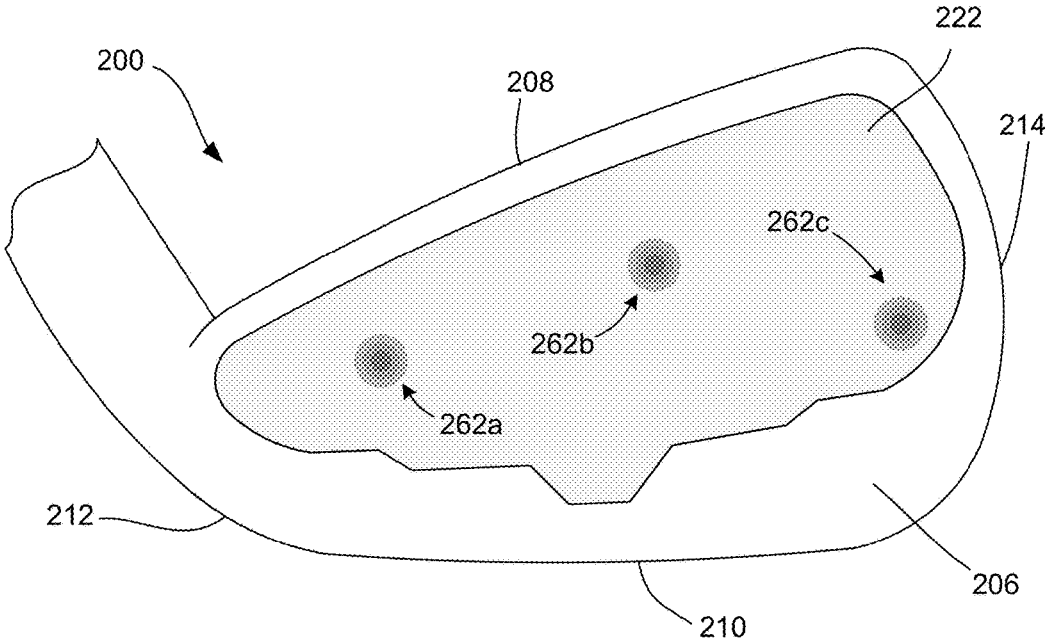
FIG. 31 is a rear view of the golf club head of FIG. 30 showing individual emissions of light along different portions of the damping assembly so as to indicate impacts between the ball striking face and the golf ball.

FIG. 31 is a rear view of the golf club head 200 of FIG. 30 showing individual emissions of light 262*a*-262*c* along different portions of the damping assembly 222 so as to indicate impacts between the ball striking face and the golf ball. As shown, not only does the damping assembly 222 provide a visual indication as to where on the club face 216 the golf ball was struck, but also the intensity of the golf ball strike, providing a golfer with an indication of their power in the golf shot.

Figure 32:
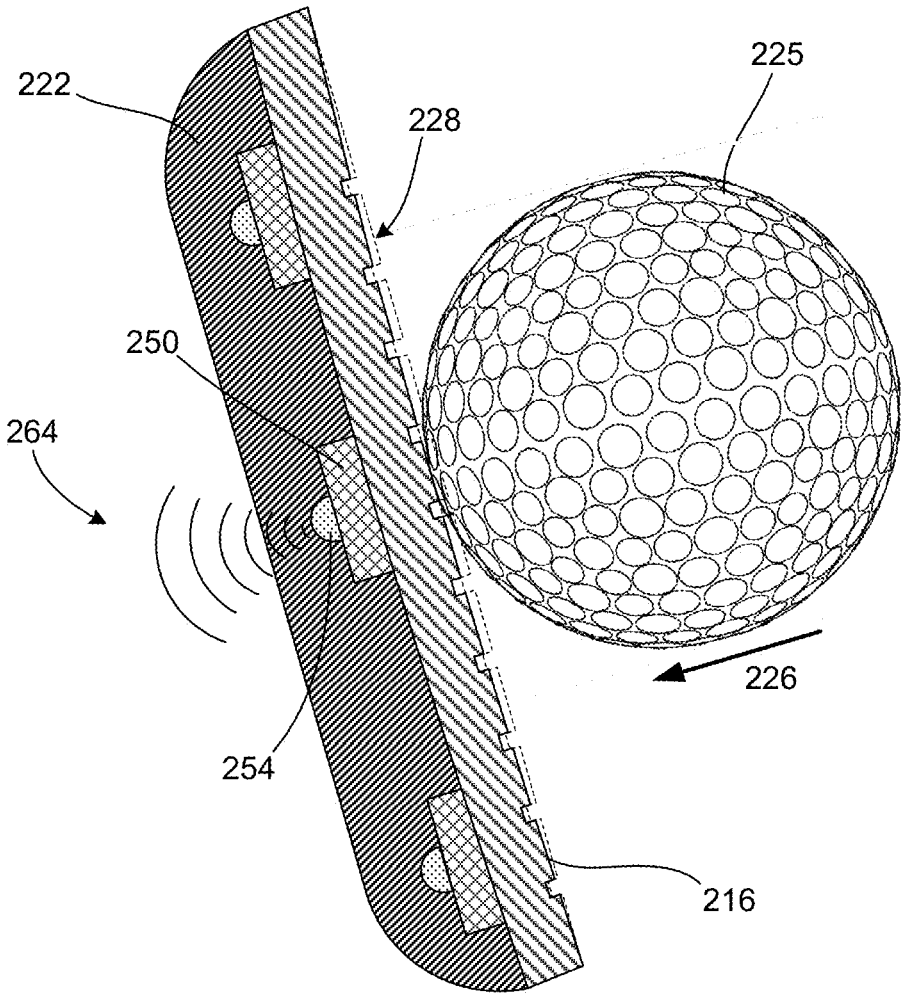
FIG. 32 is a cross-sectional view of a golf club head including another embodiment of a damping assembly having one or more piezoelectric sensors and one or more sound-emitting devices (e.g., speakers) configured to emit a sound to provide audible indication of one or more characteristics of a force imparted on at least a piezoelectric sensor based on the impact between the ball striking face and a golf ball.

FIG. 32 is a cross-sectional view of a golf club head 200 in which the damping assembly 222 includes one or more piezoelectric sensors 250 and one or more sound-emitting devices 254 in electrical communication with the piezoelectric sensors 250. The one or more sound emitting devices 264 are configured to emit a sound in response to application of an electrical signal thereto from one or more piezoelectric sensors 250. The emitted sound provides an audible indication of one or more characteristics of a force imparted on at least one of the piezoelectric sensors 250 based on the impact between the ball striking face 216 and a golf ball 225. In one embodiment, the sound-emitted devices 254 may include, for example, a speaker.

The speaker 254 may be configured to emit a sound indicative of one or more characteristics of the impact between the ball striking face 216 and the golf ball 225, including, but not limited to, magnitude of the impact, distribution of the impact on the ball striking face 216, location of the impact on the ball striking face 216, and a combination of at least two thereof. For example, in one embodiment, a speaker 254 may be configured to emit different intensities of sound and/or different sounds indicative of corresponding magnitudes of impact between the club face 216 and golf ball 225 and/or the location of impact on the club face 216. In this example, a speaker 254 may have an integrated driver circuitry or may be coupled to the controller/driver circuitry 256 (shown in FIG. 27) configured to control the sound emission of the speaker 254. In particular, the controller/driver circuitry 256 may be configured to receive an electrical signal generated by a piezoelectric sensor 250 and further control sound emission of a speaker 254 based on the electrical signal.

For example, upon receipt of a first electrical signal (having a first voltage) from a piezoelectric sensor, the controller/driver circuitry 256 may be configured to control the speaker to emit a first sound pattern (e.g., sound intensity, sound effect, informative data in sound, etc.) corresponding the first electrical signal. In this instance, the first electrical signal may be generated based on a golf ball strike having a relatively high impact force (e.g., high impact golf ball strike). Accordingly, the speaker 254 may be controlled to emit a really intense and loud sound effect (e.g., sound of an explosion), thereby indicating to a golfer that the shot was of high impact. Upon receipt of a second electrical signal (having a second voltage) from the piezoelectric sensor 250, the controller/driver circuitry 256 may be configured to control the speaker 254 to emit a second sound pattern corresponding the second electrical signal. In this instance, the second electrical signal may be generated based on a golf ball strike having a low or medium impact force. In turn, the speaker 254 may be controlled to emit a less intense sound effect (smaller explosion sound) and/or a different sound effect altogether (e.g., "dud" sound effect), thereby indicating to a golfer that the shot was of low or medium impact. In some embodiments, a single speaker 254 may be included and the controller/driver circuitry 256 may be configured to determine from which piezoelectric sensor any given electrical signal is being received, wherein the controller/driver circuitry 256 may be configured to control the speaker 254 to output a sound including informative data (e.g., spoken word sound effect) indicating the location of the face making impact with the golf ball 225 (e.g., toe, heel, sole, topline, center), so as to provide audible indication of the location of the golf ball strike.

Figure 33:
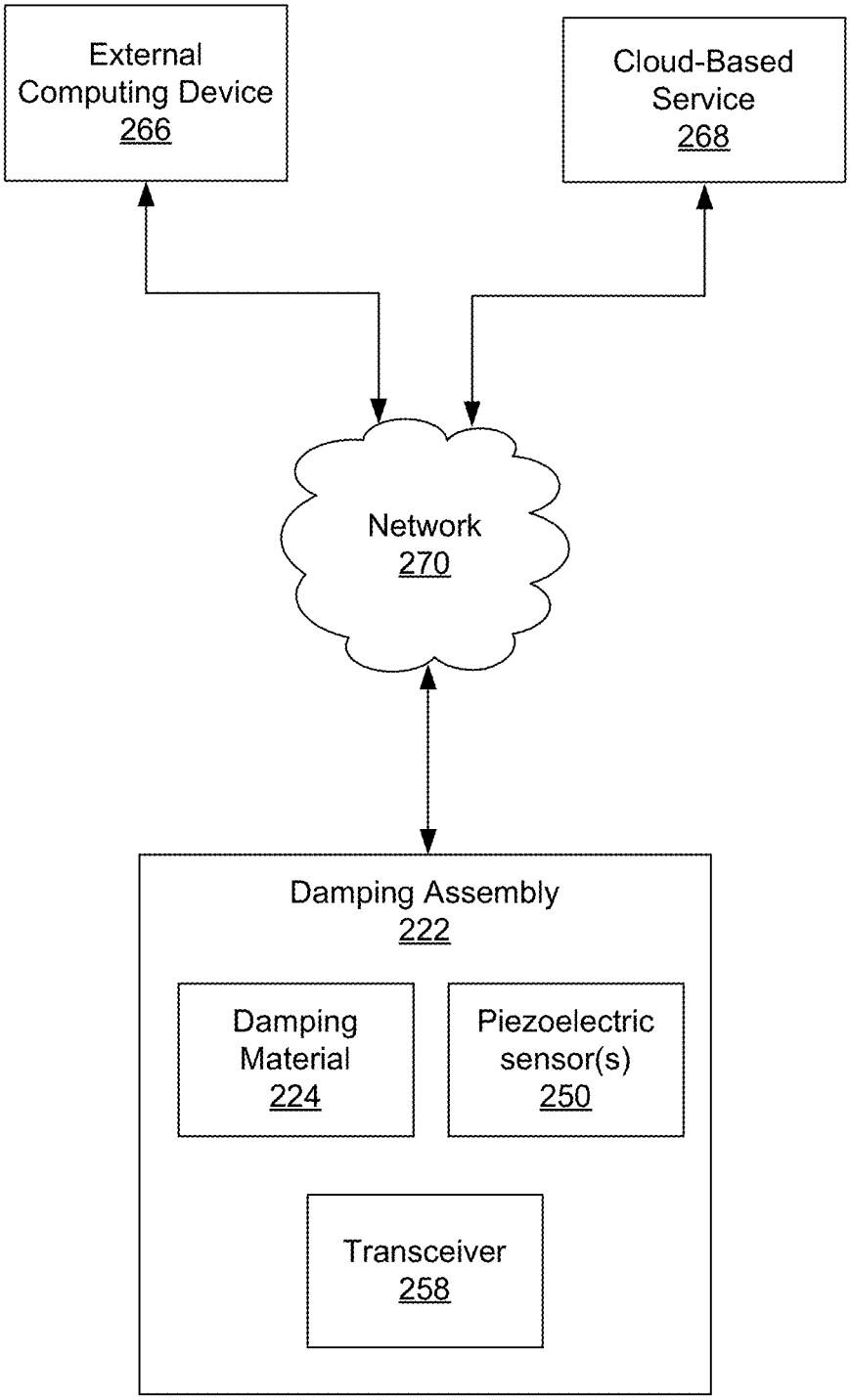
FIG. 33 is a block diagram illustrating one embodiment of an exemplary system for communicating impact data with an external computing device.

FIG. 33 is a block diagram illustrating one embodiment of an exemplary system for communicating impact data with an external computing device. As shown in FIG. 27, a damping assembly consistent with the present disclosure may further include a transceiver device 258 configured to communicate and share impact data related to the at least one electrical signal with an external computing device 266, the external computing device 266 configured to provide a golfer with shot data based the impact data.

As shown, the damping assembly 222 is configured to communicate and share shot data with at least with an external computing device 266 and/or an internet-based service (e.g., cloud-based service 268) over a network 270. In particular, for any given golf ball strike, the one or more piezoelectric sensors 250 are configured to generate an electrical signal including data related to the golf ball strike. The data may include one or more characteristics of the impact between the ball striking face 216 and the golf ball 225, including, but not limited to, magnitude of the impact, distribution of the impact on the ball striking face 216, location of the impact on the ball striking face 216, and a combination of at least two thereof. Accordingly, the electrical signals may include shot data. The transceiver 258 of the damping assembly 222 is configured to wirelessly communicate and share shot data associated with electrical signals with at least one of the external computing device 266 and cloud-based service 268.

The external computing device 266 may be embodied as any type of device for communicating with the transceiver 258 and for receiving the shot data and converting such shot data for visual presentation to a golfer, as will be described in greater detail herein. For example, the external computing device 266 may be embodied as, without limitation, a computer, a desktop computer, a personal computer (PC), a tablet computer, a laptop computer, a notebook computer, a mobile computing device, a smart phone, a cellular telephone, a handset, a messaging device, a work station, a network appliance, a web appliance, a distributed computing system, a multiprocessor system, a processor-based system, a consumer electronic device, and/or any other computing device configured to store and access data, and/or to execute software and related applications consistent with the present disclosure. In one aspect, external computing device 266 is a one of many commercially-available tablet PCs, notebook PCs or convertible notebook PCs that can be used as tablet PCs.

In some embodiments, shot data may be shared with an internet-based service, or other external computing configuration in which there are one or more remote servers networked to allow a centralized data storage and online access to such data. For example, in one embodiment, shot data may be shared with a cloud-based service 268, for example, and provide an interface such that a golfer may the cloud-based service and further gain access to their shot data so as to view their performance.

The network 270 may be any network that carries data. Non-limiting examples of suitable networks that may be used as network 16 include Wi-Fi wireless data communication technology, the internet, private networks, virtual private networks (VPN), public switch telephone networks (PSTN), integrated services digital networks (ISDN), digital subscriber link networks (DSL), various second generation (2G), third generation (3G), fourth generation (4G) cellular-based data communication technologies, Bluetooth radio, Near Field Communication (NFC), other networks capable of carrying data, and combinations thereof. In some embodiments, network 16 is chosen from the internet, at least one wireless network, at least one cellular telephone network, and combinations thereof. As such, the network 16 may include any number of additional devices, such as additional computers, routers, and switches, to facilitate communications. In some embodiments, the network 270 may be or include a single network, and in other embodiments the network 16 may be or include a collection of networks.

Figure 34:
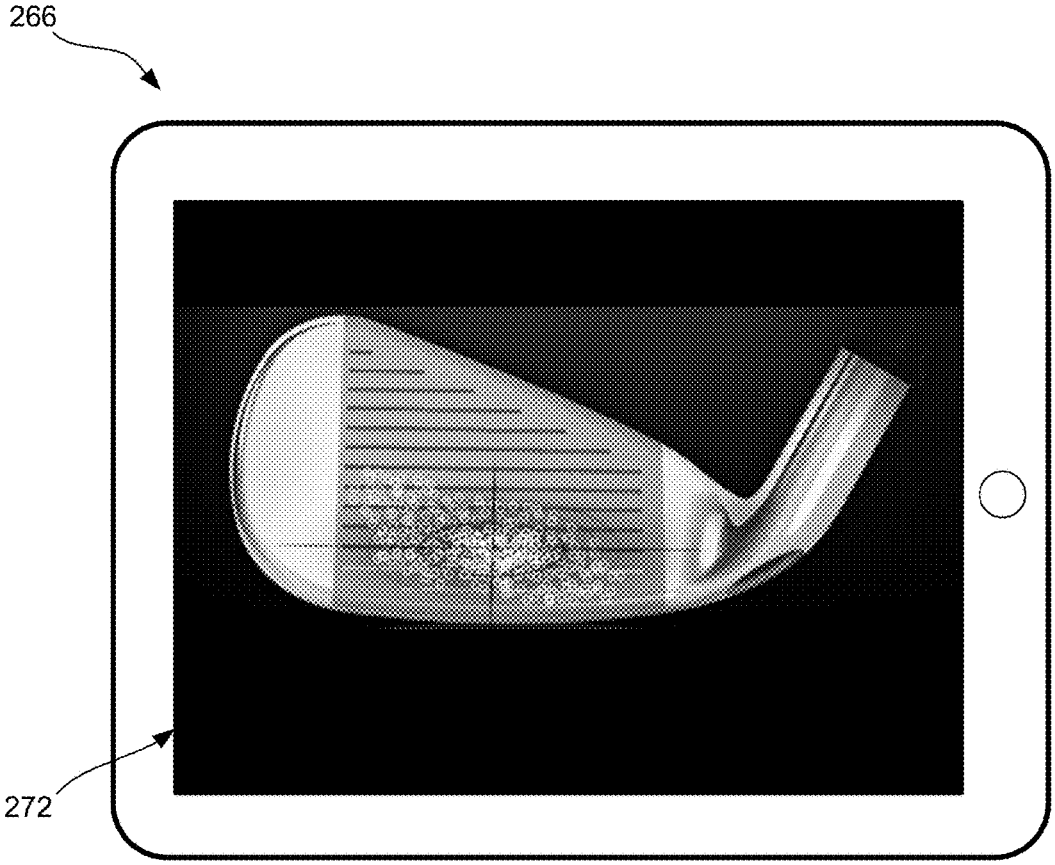
FIG. 34 illustrates the presentation of shot data on a virtual depiction of the ball striking face of the club head based on the impact data provided by transceiver of the damping assembly of FIG. 33.

FIG. 34 illustrates the presentation of shot data on a display of the external computing device 266. As shown, the external computing device 266 is a tablet PC. The computing device 266 may include software configured to render a visual display of the shot data received from the transceiver 258. In particular, the computing device 266 may provide a virtual depiction 272 of the ball striking face of the club head and further provide a visual presentation of the shot data provided by the transceiver 258. As shown, the shot data may include at least one of magnitude of impact between the ball striking face and the golf ball, distribution of impact on the ball striking face, location of impact on the ball striking face, and a combination of at least two thereof.

In some embodiments, the invention provides software for processing shot data as captured by the damping assembly 222. Software can be an app that a golfer downloads onto a device, an application that a golfer installs onto a computing device, one or more programs that run on a web server accessible, for example, via a web page, or any combination thereof. By installing the golf-data analyzing software or running it in the memory of a computer device, including a memory coupled to processor, the processor can execute one or more programs to analyze data related to the playing of golf. Analysis includes displaying, comparing, and calculating (e.g., taking an average or interpolating a trend).

A game improvement program can be administered using electronic devices as well as computer systems and computer program-based analytical tools. Thus, using devices and methods of the invention, a golfer can gather information during their game and use that information to analyze their performance or to enhance their enjoyment of the game by, for example, competing electronically with their friends, comparing their performance to a pro's, or documenting their performance over time. Exemplary systems and methods for improving performance to enhance enjoyment of golf by data collection are discussed in Systems and Methods for Communication Sports-Related Information, U.S. Pub. 2012/0316843, Method and System for Athletic Motion Analysis and Instruction, U.S. Pub. 2007/0270214, and Method and System for Athletic Motion Analysis and Instruction, U.S. Pub. 2006/0166737, the contents of each of which are hereby incorporated by reference in their entirety.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

As used in any embodiment herein, the term "module" may refer to software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices. "Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The modules may, collectively or individually, be embodied as circuitry that forms part of a larger system, for example, an integrated circuit (IC), system on-chip (SoC), desktop computers, laptop computers, tablet computers, servers, smart phones, etc.

Any of the operations described herein may be implemented in a system that includes one or more storage mediums having stored thereon, individually or in combination, instructions that when executed by one or more processors perform the methods. Here, the processor may include, for example, a server CPU, a mobile device CPU, and/or other programmable circuitry.

Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), magnetic or optical cards, or any type of media suitable for storing electronic instructions. Other embodiments may be implemented as software modules executed by a programmable control device. The storage medium may be non-transitory.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

As used herein, directional references such as rear, front, lower, etc. are made with respect to the club head when grounded at the address position. See, for example, FIGS. 1 and 2. The direction references are included to facilitate comprehension of the inventive concepts disclosed herein, and should not be read as limiting.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a club head body comprising a front portion, a rear portion, a topline, a sole, a heel, and a toe;

a ball striking face disposed on the front portion of the club head body; and a damping assembly positioned adjacent to a rear surface of the ball striking face, the damping assembly configured to dampen vibrations in the club head upon impact between the ball striking face and a golf ball and further configured to provide feedback to a golfer indicative of one or more characteristics of the impact between the ball striking face and the golf ball, the damping assembly comprises:

a damping material, at least a portion of which is in contact with the rear surface of the ball striking face and configured to receive and dissipate a deflection force imparted thereon from the ball striking face caused by the impact between the ball striking face and the golf ball, wherein the damping material is configured to adjust in appearance in response to the deflection force to visually indicate impact between the ball striking face and the golf ball, the damping material comprises a chromogenic polymer configured to transition between one of a plurality of colors in response to application of one of a plurality of predetermined forces imparted thereon, wherein each of the plurality of colors correlates to at least a magnitude of force of an associated predetermined force.

2. The golf club head of claim 1, wherein the one or more characteristics of the impact between the ball striking face and the golf ball are selected from the group consisting of magnitude of the impact, distribution of the impact on the ball striking face, location of the impact on the ball striking face, and a combination of at least two thereof.

3. The golf club head of claim 1, wherein the damping material is selected from the group consisting of a bulk molding compound, rubber, urethane, polyurethane, a viscoelastic material, a thermoplastic or thermoset polymer, butadiene, polybutadiene, silicone, and a combination of at least two thereof.

4. The golf club head of claim 1, wherein the damping assembly further comprises:

at least one piezoelectric sensor in contact with a portion of the rear surface of the ball striking face and configured to generate at least one electrical signal in response to receipt of the deflection force from the ball striking face, wherein the at least one electrical signal corresponds to the deflection force.

5. The golf club head of claim 4, wherein the at least one piezoelectric sensor is configured to generate one of a plurality of electrical signals in response to receipt of one of a plurality of predetermined forces imparted thereon, wherein each of the plurality of electrical signals correlates to at least a magnitude of force of an associated predetermined force.

6. The golf club head of claim 5, wherein the damping material is configured to adjust in appearance in response to the application of the at least one electrical signal thereto.

7. The golf club head of claim 4, wherein the at least one piezoelectric sensor is in electrical communication with a light source, wherein the light source is configured to emit light to visually indicate impact between the ball striking face and the golf ball in response to the at least one electrical signal.

8. A golf club head comprising:

a club head body comprising a front portion, a rear portion, a topline, a sole, a heel, and a toe;

a ball striking face disposed on the front portion of the club head body; and a damping assembly positioned adjacent to a rear surface of the ball striking face, the damping assembly configured to dampen vibrations in the club head upon impact between the ball striking face and a golf ball and further configured to provide feedback to a golfer indicative of one or more characteristics of the impact between the ball striking face and the golf ball, the damping assembly comprises:

a damping material, at least a portion of which is in contact with the rear surface of the ball striking face and configured to receive and dissipate a deflection force imparted thereon from the ball striking face caused by the impact between the ball striking face and the golf ball; and at least one piezoelectric sensor in contact with a portion of the rear surface of the ball striking face and configured to generate at least one electrical signal in response to receipt of the deflection force from the ball striking face, wherein the at least one electrical signal corresponds to the deflection force, wherein the at least one piezoelectric sensor is configured to generate one of a plurality of electrical signals in response to receipt of one of a plurality of predetermined forces imparted thereon, wherein each of the plurality of electrical signals correlates to at least a magnitude of force of an associated predetermined force, wherein the damping material is configured to adjust in appearance in response to the application of the at least one electrical signal thereto, the damping material comprises a chromogenic polymer configured to transition between one of a plurality of colors in response to application of an associated one of a plurality of electrical signals applied thereto, wherein each of the plurality of colors correlates to a magnitude of force of an associated electrical signal.

9. A golf club head comprising:

a club head body comprising a front portion, a rear portion, a topline, a sole, a heel, and a toe;

a ball striking face disposed on the front portion of the club head body; and a damping assembly positioned adjacent to a rear surface of the ball striking face, the damping assembly configured to dampen vibrations in the club head upon impact between the ball striking face and a golf ball and further configured to provide feedback to a golfer indicative of one or more characteristics of the impact between the ball striking face and the golf ball, the damping assembly comprises:

a damping material, at least a portion of which is in contact with the rear surface of the ball striking face and configured to receive and dissipate a deflection force imparted thereon from the ball striking face caused by the impact between the ball striking face and the golf ball; and at least one piezoelectric sensor in contact with a portion of the rear surface of the ball striking face and configured to generate at least one electrical signal in response to receipt of the deflection force from the ball striking face, wherein the at least one electrical signal corresponds to the deflection force, wherein the at least one piezoelectric sensor is in electrical communication with a sound-emitting device, wherein the sound-emitting device is configured to emit a sound to audibly indicate impact between the ball striking face and the golf ball in response to receipt of the at least one electrical signal.

10. A golf club head comprising:

a club head body comprising a front portion, a rear portion, a topline, a sole, a heel, and a toe;

a ball striking face disposed on the front portion of the club head body; and a damping assembly positioned adjacent to a rear surface of the ball striking face, the damping assembly configured to dampen vibrations in the club head upon impact between the ball striking face and a golf ball and further configured to provide feedback to a golfer indicative of one or more characteristics of the impact between the ball striking face and the golf ball, the damping assembly comprises:

a damping material, at least a portion of which is in contact with the rear surface of the ball striking face and configured to receive and dissipate a deflection force imparted thereon from the ball striking face caused by the impact between the ball striking face and the golf ball;

at least one piezoelectric sensor in contact with a portion of the rear surface of the ball striking face and configured to generate at least one electrical signal in response to receipt of the deflection force from the ball striking face, wherein the at least one electrical signal corresponds to the deflection force; and a transceiver device configured to communicate and share impact data related to the at least one electrical signal with an external computing device, the external computing device configured to provide a golfer with shot data based the impact data.

11. A golf club head comprising:

a club head body comprising a front portion, a rear portion, a topline, a sole, a heel, and a toe;

a ball striking face disposed on the front portion of the club head body; and a damping assembly positioned adjacent to a rear surface of the ball striking face, the damping assembly configured to dampen vibrations in the club head upon impact between the ball striking face and a golf ball and further configured to provide feedback to a golfer indicative of one or more characteristics of the impact between the ball striking face and the golf ball, the damping assembly comprises:

a damping material, at least a portion of which is in contact with the rear surface of the ball striking face and configured to receive and dissipate a deflection force imparted thereon from the ball striking face caused by the impact between the ball striking face and the golf ball;

at least one piezoelectric sensor in contact with a portion of the rear surface of the ball striking face and configured to generate at least one electrical signal in response to receipt of the deflection force from the ball striking face, wherein the at least one electrical signal corresponds to the deflection force; and a transceiver device configured to communicate and share impact data related to the at least one electrical signal with an external computing device, the external computing device configured to provide a golfer with shot data based the impact data, wherein the external computing device is configured to provide a visual display of shot data, the shot data including at least one of magnitude of impact between the ball striking face and the golf ball, distribution of impact on the ball striking face, location of impact on the ball striking face, and a combination of at least two thereof.

12. A golf club head comprising:

a club head body comprising a front portion, a rear portion, a topline, a sole, a heel, a toe;

a ball striking face disposed on the front portion of the club head body; and a damping assembly positioned adjacent to a rear surface of the ball striking face, the damping assembly comprising:

a damping material, at least a portion of which is in contact with the rear surface of the ball striking face and configured to receive and dissipate a deflection force imparted thereon from the ball striking face caused by an impact between the ball striking face and the golf ball;

at least one piezoelectric sensor in contact with a portion of the rear surface of the ball striking face and configured to generate at least one electrical signal in response to receipt of the deflection force imparted thereon from the ball striking face, wherein the at least one electrical signal includes impact data corresponding to the deflection force; and at least one light-emitting diode in communication with the at least one piezoelectric sensor and configured to emit light to visually indicate the impact between the ball striking face and the golf ball in response to receipt of the at least one electrical signal, wherein the at least one light-emitting diode is configured to emit light in a predetermined pattern so as to provide a visual indication of one or more characteristics of the impact between the ball striking face and the golf ball, the one or more characteristics including as least one of a magnitude of the impact, a distribution of the impact on the ball striking face, and location of the impact on the ball striking face, wherein intensity of light emitted from the light-emitting diode corresponds to the magnitude of impact between the ball striking face and the golf ball.

13. A golf club head comprising:

a club head body comprising a front portion, a rear portion, a topline, a sole, a heel, a toe;

a ball striking face disposed on the front portion of the club head body; and a damping assembly positioned adjacent to a rear surface of the ball striking face, the damping assembly comprising:

a damping material, at least a portion of which is in contact with the rear surface of the ball striking face and configured to receive and dissipate a deflection force imparted thereon from the ball striking face caused by an impact between the ball striking face and the golf ball;

at least one piezoelectric sensor in contact with a portion of the rear surface of the ball striking face and configured to generate at least one electrical signal in response to receipt of the deflection force imparted thereon from the ball striking face, wherein the at least one electrical signal includes impact data corresponding to the deflection force; and at least one light-emitting diode in communication with the at least one piezoelectric sensor and configured to emit light to visually indicate the impact between the ball striking face and the golf ball in response to receipt of the at least one electrical signal, wherein the at least one light-emitting diode is configured to emit light in a predetermined pattern so as to provide a visual indication of one or more characteristics of the impact between the ball striking face and the golf ball, the one or more characteristics including as least one of a magnitude of the impact, a distribution of the impact on the ball striking face, and location of the impact on the ball striking face, wherein the at least one piezoelectric sensor is further in electrical communication with a sound-emitting device, wherein the sound-emitting device is configured to emit a sound to audibly indicate the impact between the ball striking face and the golf ball in response to receipt of the at least one electrical signal.

14. A golf club head comprising:

a club head body comprising a front portion, a rear portion, a topline, a sole, a heel, a toe;

a ball striking face disposed on the front portion of the club head body; and a damping assembly positioned adjacent to a rear surface of the ball striking face, the damping assembly comprising:

a damping material, at least a portion of which is in contact with the rear surface of the ball striking face and configured to receive and dissipate a deflection force imparted thereon from the ball striking face caused by an impact between the ball striking face and the golf ball;

at least one piezoelectric sensor in contact with a portion of the rear surface of the ball striking face and configured to generate at least one electrical signal in response to receipt of the deflection force imparted thereon from the ball striking face, wherein the at least one electrical signal includes impact data corresponding to the deflection force; and at least one light-emitting diode in communication with the at least one piezoelectric sensor and configured to emit light to visually indicate the impact between the ball striking face and the golf ball in response to receipt of the at least one electrical signal, wherein the at least one light-emitting diode is configured to emit light in a predetermined pattern so as to provide a visual indication of one or more characteristics of the impact between the ball striking face and the golf ball, the one or more characteristics including as least one of a magnitude of the impact, a distribution of the impact on the ball striking face, and location of the impact on the ball striking face, wherein the at least one piezoelectric sensor is further in electrical communication with a sound-emitting device, wherein the sound-emitting device is configured to emit a sound to audibly indicate the impact between the ball striking face and the golf ball in response to receipt of the at least one electrical signal, wherein intensity of sound emitted from the sound-emitting device corresponds to the magnitude of impact between the ball striking face and the golf ball.

15. A golf club head comprising:

a club head body comprising a front portion, a rear portion, a topline, a sole, a heel, a toe;

a ball striking face disposed on the front portion of the club head body and a damping assembly positioned adjacent to a rear surface of the ball striking face, the damping assembly comprising:

a damping material, at least a portion of which is in contact with the rear surface of the ball striking face and configured to receive and dissipate a deflection force imparted thereon from the ball striking face caused by the impact between the ball striking face and the golf ball; and at least one piezoelectric sensor in contact with a portion of the rear surface of the ball striking face and configured to generate at least one electrical signal having a predetermined voltage in response to receipt of the deflection force imparted thereon from the ball striking face, wherein the at least one electrical signal corresponds to the deflection force, wherein the damping material is a chromogenic polymer configured to transition between one of a plurality of colors in response to application of the at least one electrical signal thereto based, at least in part, on the predetermined voltage of the at least one electrical signal, wherein the color appearance of the chromogenic polymer provides a visual indication of one or more characteristics of the impact between the ball striking face and the golf ball, the one or more characteristics including at least one of a magnitude of the impact, a distribution of the impact on the ball striking face, and location of the impact on the ball striking face.

* * * * *